US007029756B2

(12) United States Patent
Moline et al.

(10) Patent No.: US 7,029,756 B2
(45) Date of Patent: Apr. 18, 2006

(54) SOFT TISSUE HYDROPHILIC TISSUE PRODUCTS CONTAINING POLYSILOXANE AND HAVING UNIQUE ABSORBENT PROPERTIES

(75) Inventors: David Andrew Moline, Appleton, WI (US); Dale Alan Burghardt, Buttes des Morts, WI (US); Thomas Gerard Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/289,557

(22) Filed: Nov. 6, 2002

(65) Prior Publication Data

US 2004/0086726 A1 May 6, 2004

(51) Int. Cl.
*D21H 17/59* (2006.01)
*B32B 7/00* (2006.01)

(52) U.S. Cl. ..... 428/452; 162/123; 162/127; 162/132; 162/164.4; 162/219; 524/838

(58) Field of Classification Search ..... 428/447
See application file for complete search history.

(56) References Cited

U.S. PATENT DOCUMENTS

| | | | |
|---|---|---|---|
| 2,345,543 | A | 3/1944 | Wohnsiedler et al. |
| 2,926,116 | A | 2/1960 | Keim |
| 2,926,154 | A | 2/1960 | Keim |
| 3,556,932 | A | 1/1971 | Coscia et al. |
| 3,556,933 | A | 1/1971 | Williams et al. |
| 3,695,269 | A | 10/1972 | Malaney |
| 3,700,623 | A | 10/1972 | Keim |
| 3,722,469 | A | 3/1973 | Bartley et al. |
| 3,772,076 | A | 11/1973 | Keim |
| 3,838,692 | A | 10/1974 | Levesque |
| 3,849,241 | A | 11/1974 | Butin et al. |
| 3,855,158 | A | 12/1974 | Petrovich et al. |
| 3,865,078 | A | 2/1975 | De Howitt et al. |
| 3,879,257 | A | 4/1975 | Gentile et al. |
| 3,885,158 | A | 5/1975 | Flutie et al. |
| 3,899,387 | A | 8/1975 | Freis et al. |
| 3,899,388 | A | 8/1975 | Petrovich et al. |
| 3,905,329 | A | 9/1975 | Cone et al. |
| 3,930,465 | A | 1/1976 | Schuierer |
| 4,005,028 | A | 1/1977 | Heckert et al. |
| 4,005,030 | A | 1/1977 | Heckert et al. |
| 4,016,831 | A | 4/1977 | James et al. |
| 4,023,526 | A | 5/1977 | Ashmus et al. |
| 4,061,001 | A | 12/1977 | Von Der Eltz et al. |
| 4,081,318 | A | 3/1978 | Wietsma |
| 4,089,296 | A | 5/1978 | Barchi |
| 4,099,913 | A | 7/1978 | Walter et al. |
| 4,100,324 | A | 7/1978 | Anderson et al. |
| 4,112,167 | A | 9/1978 | Dake et al. |
| 4,118,526 | A | 10/1978 | Gregorian et al. |
| 4,129,528 | A | 12/1978 | Petrovich et al. |
| 4,147,586 | A | 4/1979 | Petrovich et al. |
| 4,158,076 | A | 6/1979 | Wallsten |
| 4,159,355 | A | 6/1979 | Kaufman |
| 4,162,190 | A | 7/1979 | Ashworth |
| 4,184,914 | A | 1/1980 | Jenkins |
| 4,193,762 | A | 3/1980 | Namboodri |
| 4,198,316 | A | 4/1980 | Nahta |
| 4,222,921 | A | 9/1980 | Van Eenam |
| 4,230,746 | A | 10/1980 | Nahta |
| 4,237,818 | A | 12/1980 | Clifford et al. |
| 4,263,344 | A | 4/1981 | Radvan et al. |
| 4,276,339 | A | 6/1981 | Stoveken |
| 4,279,964 | A | 7/1981 | Heller |
| 4,287,251 | A | 9/1981 | King et al. |
| 4,288,475 | A | 9/1981 | Meeker |
| 4,297,860 | A | 11/1981 | Pacifici et al. |
| 4,305,169 | A | 12/1981 | Vidalis |
| 4,326,000 | A | 4/1982 | Roberts |
| 4,343,835 | A | 8/1982 | Jones et al. |
| 4,348,251 | A | 9/1982 | Pauls et al. |
| 4,364,784 | A | 12/1982 | Van Wersch et al. |
| 4,366,682 | A | 1/1983 | Keller |
| 4,377,615 | A | 3/1983 | Suzuki et al. |
| 4,384,867 | A | 5/1983 | Gruber |
| 4,385,954 | A | 5/1983 | Pauls et al. |
| 4,387,118 | A | 6/1983 | Shelton |
| 4,400,953 | A | 8/1983 | Driessen et al. |

(Continued)

FOREIGN PATENT DOCUMENTS

DE 252 208 A1 12/1987

(Continued)

OTHER PUBLICATIONS

Foulger, M. et al., "New Technology to Apply Starch and Other Additivies," *Pulp & Paper Canada*, vol. 100, No. 2, 1999, pp. 24-25.

(Continued)

*Primary Examiner*—Marc S Zimmer
(74) *Attorney, Agent, or Firm*—Gregory E. Croft

(57) ABSTRACT

The present invention is a tissue product having two outer surfaces and at least one layered tissue sheet. The layered tissue sheet has two outer layers. The tissue product comprises at least one layer of the layered tissue sheet comprises polysiloxane pretreated pulp fibers and at least one layer of the layered tissue sheet comprises non-treated pulp fibers. At least one layer of the layered tissue sheet comprises polysiloxane pretreated pulp fibers such that one layer comprising polysiloxane pretreated pulp fibers is adjacent to a layer comprising non-treated pulp fibers.

92 Claims, 1 Drawing Sheet

U.S. PATENT DOCUMENTS

| | | | |
|---|---|---|---|
| 4,402,200 | A | 9/1983 | Clifford et al. |
| 4,406,737 | A | 9/1983 | Latimer et al. |
| 4,408,996 | A | 10/1983 | Baldwin |
| 4,414,268 | A | 11/1983 | Baldwin |
| 4,425,186 | A | 1/1984 | May et al. |
| 4,425,372 | A | 1/1984 | Baldwin |
| 4,426,418 | A | 1/1984 | Coleman et al. |
| 4,432,833 | A | 2/1984 | Breese |
| 4,435,965 | A | 3/1984 | Sasseville et al. |
| 4,440,597 | A | 4/1984 | Wells et al. |
| 4,440,808 | A | 4/1984 | Mitter |
| 4,442,771 | A | 4/1984 | Mitter |
| 4,444,104 | A | 4/1984 | Mitter |
| 4,453,462 | A | 6/1984 | Mitter |
| 4,463,467 | A | 8/1984 | Gruber et al. |
| 4,463,583 | A | 8/1984 | Kruger et al. |
| 4,474,110 | A | 10/1984 | Rosner |
| 4,481,243 | A | 11/1984 | Allen |
| 4,497,273 | A | 2/1985 | Mitter |
| 4,498,318 | A | 2/1985 | Mitter |
| 4,501,038 | A | 2/1985 | Otting |
| 4,502,304 | A | 3/1985 | Hopkins |
| 4,514,345 | A | 4/1985 | Johnson et al. |
| 4,528,239 | A | 7/1985 | Trokhan |
| 4,529,480 | A | 7/1985 | Trokhan |
| 4,534,189 | A | 8/1985 | Clifford |
| 4,537,822 | A | 8/1985 | Nanri et al. |
| 4,551,199 | A | 11/1985 | Weldon |
| 4,552,778 | A | 11/1985 | Zimmer |
| 4,556,450 | A | 12/1985 | Chuang et al. |
| 4,557,218 | A | 12/1985 | Sievers |
| 4,559,162 | A | 12/1985 | Heinz et al. |
| 4,559,243 | A | 12/1985 | Passler et al. |
| 4,562,097 | A | 12/1985 | Walter et al. |
| 4,571,360 | A | 2/1986 | Brown et al. |
| 4,576,112 | A | 3/1986 | Funger et al. |
| 4,581,254 | A | 4/1986 | Cunningham et al. |
| 4,588,457 | A | 5/1986 | Crenshaw et al. |
| 4,597,831 | A | 7/1986 | Anderson |
| 4,603,176 | A | 7/1986 | Bjorkquist et al. |
| 4,605,702 | A | 8/1986 | Guerro et al. |
| 4,610,915 | A | 9/1986 | Crenshaw et al. |
| 4,612,874 | A | 9/1986 | Mitter |
| 4,618,689 | A | 10/1986 | Traver et al. |
| 4,646,675 | A | 3/1987 | Arthur et al. |
| 4,655,056 | A | 4/1987 | Zeiffer |
| 4,665,723 | A | 5/1987 | Zimmer |
| 4,667,882 | A | 5/1987 | Pacifici |
| 4,699,988 | A | 10/1987 | Traver et al. |
| 4,731,092 | A | 3/1988 | Berendt |
| 4,734,100 | A | 3/1988 | Berendt et al. |
| 4,741,739 | A | 5/1988 | Berendt et al. |
| 4,762,727 | A | 8/1988 | Voswinckel |
| 4,773,110 | A | 9/1988 | Hopkins |
| 4,778,477 | A | 10/1988 | Lauchenauer |
| 4,792,619 | A | 12/1988 | Berendt et al. |
| 4,799,278 | A | 1/1989 | Beeh |
| 4,816,320 | A | 3/1989 | St. Cyr |
| 4,833,748 | A | 5/1989 | Zimmer et al. |
| 4,872,325 | A | 10/1989 | Moser et al. |
| 4,886,632 | A | 12/1989 | Van Iten et al. |
| 4,894,054 | A | 1/1990 | Miskinyar |
| 4,894,118 | A | 1/1990 | Edwards et al. |
| 4,905,545 | A | 3/1990 | Leising et al. |
| 4,911,956 | A | 3/1990 | Gabryszewski et al. |
| 4,912,948 | A | 4/1990 | Brown et al. |
| 4,919,877 | A | 4/1990 | Parsons et al. |
| 4,925,528 | A | 5/1990 | Tse et al. |
| 4,943,350 | A | 7/1990 | Bogart et al. |
| 4,950,545 | A | 8/1990 | Walter et al. |
| 5,008,131 | A | 4/1991 | Bakhshi |
| 5,009,932 | A | 4/1991 | Klett et al. |
| 5,048,589 | A | 9/1991 | Cook et al. |
| 5,059,282 | A | 10/1991 | Ampulski et al. |
| 5,089,296 | A | 2/1992 | Bafford et al. |
| 5,098,522 | A | 3/1992 | Smurkoski et al. |
| 5,098,979 | A | 3/1992 | O'lenick, Jr. |
| 5,145,527 | A | 9/1992 | Clifford et al. |
| 5,164,046 | A | 11/1992 | Ampulski et al. |
| 5,165,261 | A | 11/1992 | Cho |
| 5,178,729 | A | 1/1993 | Janda |
| 5,215,626 | A | 6/1993 | Ampulski et al. |
| 5,215,629 | A | 6/1993 | Skatulla et al. |
| 5,219,620 | A | 6/1993 | Potter et al. |
| 5,227,023 | A | 7/1993 | Pounder et al. |
| 5,227,242 | A | 7/1993 | Walter et al. |
| 5,230,776 | A | 7/1993 | Andersson et al. |
| 5,234,547 | A | 8/1993 | Knight et al. |
| 5,237,035 | A | 8/1993 | O'lenick, Jr. et al. |
| 5,245,545 | A | 9/1993 | Taylor |
| 5,246,545 | A | 9/1993 | Ampulski et al. |
| 5,246,546 | A | 9/1993 | Ampulski |
| 5,260,171 | A | 11/1993 | Smurkoski et al. |
| 5,275,700 | A | 1/1994 | Trokhan |
| 5,277,242 | A | 1/1994 | Arrington |
| 5,328,565 | A | 7/1994 | Rasch et al. |
| 5,328,685 | A | 7/1994 | Janchitraponvej et al. |
| 5,334,289 | A | 8/1994 | Trokhan et al. |
| 5,348,609 | A | 9/1994 | Russell et al. |
| 5,353,521 | A | 10/1994 | Orloff |
| 5,366,161 | A | 11/1994 | Potter et al. |
| 5,385,643 | A | 1/1995 | Ampulski |
| 5,389,204 | A | 2/1995 | Ampulski |
| 5,399,412 | A | 3/1995 | Sudall et al. |
| 5,431,786 | A | 7/1995 | Rasch et al. |
| 5,466,337 | A | 11/1995 | Darlington et al. |
| 5,479,947 | A | 1/1996 | Dyett |
| 5,492,655 | A | 2/1996 | Morton et al. |
| 5,494,554 | A | 2/1996 | Edwards et al. |
| 5,496,624 | A | 3/1996 | Stelljes et al. |
| 5,500,277 | A | 3/1996 | Trokhan et al. |
| 5,503,715 | A | 4/1996 | Trokhan et al. |
| 5,505,997 | A | 4/1996 | Strong et al. |
| 5,510,001 | A | 4/1996 | Hermans et al. |
| 5,514,523 | A | 5/1996 | Trokhan et al. |
| 5,525,345 | A | 6/1996 | Warner et al. |
| 5,529,665 | A | 6/1996 | Kaun |
| 5,538,595 | A | 7/1996 | Trokhan et al. |
| 5,552,020 | A * | 9/1996 | Smith et al. ..... 162/164.4 |
| 5,554,467 | A | 9/1996 | Trokhan et al. |
| 5,558,873 | A | 9/1996 | Funk et al. |
| 5,566,724 | A | 10/1996 | Trokhan et al. |
| 5,573,637 | A | 11/1996 | Ampulski et al. |
| 5,591,306 | A | 1/1997 | Kaun |
| 5,591,309 | A | 1/1997 | Rugowski et al. |
| 5,598,642 | A | 2/1997 | Orloff et al. |
| 5,598,643 | A | 2/1997 | Chuang et al. |
| 5,601,871 | A | 2/1997 | Krzysik et al. |
| 5,605,719 | A | 2/1997 | Tench et al. |
| 5,607,980 | A | 3/1997 | McAtee et al. |
| 5,614,293 | A | 3/1997 | Krzysik et al. |
| 5,623,043 | A | 4/1997 | Fost et al. |
| 5,624,676 | A | 4/1997 | Mackey et al. |
| 5,624,790 | A | 4/1997 | Trokhan et al. |
| 5,628,876 | A | 5/1997 | Ayers et al. |
| 5,635,191 | A | 6/1997 | Roe et al. |
| 5,635,469 | A | 6/1997 | Fowler et al. |
| 5,637,194 | A | 6/1997 | Ampulski et al. |
| 5,638,876 | A | 6/1997 | Shimotoyodome et al. |
| 5,643,588 | A | 7/1997 | Roe et al. |
| 5,650,218 | A | 7/1997 | Krzysik et al. |
| 5,656,132 | A | 8/1997 | Farrington et al. |
| 5,665,426 | A | 9/1997 | Krzysik et al. |
| 5,667,636 | A | 9/1997 | Engel et al. |

5,688,496 A 11/1997 Fost et al.
5,699,626 A 12/1997 Chuang et al.
5,701,682 A 12/1997 Chuang et al.
5,705,164 A 1/1998 Mackey et al.
5,707,434 A 1/1998 Halloran et al.
5,707,435 A 1/1998 Halloran
5,725,736 A 3/1998 Schroeder et al.
5,756,112 A 5/1998 Mackey
5,763,044 A 6/1998 Ahr et al.
5,772,845 A 6/1998 Farrington et al.
5,785,813 A 7/1998 Smith et al.
5,792,737 A 8/1998 Gruning et al.
5,807,956 A 9/1998 Czech
5,814,188 A 9/1998 Vinson et al.
5,830,317 A 11/1998 Vinson et al.
5,830,321 A 11/1998 Lindsay et al.
5,830,483 A 11/1998 Seidel et al.
5,840,403 A 11/1998 Trokhan et al.
5,846,380 A 12/1998 Van Phan et al.
5,849,313 A 12/1998 Fost et al.
5,849,447 A 12/1998 Matsuda
5,855,739 A 1/1999 Ampulski et al.
5,856,544 A 1/1999 Czech et al.
5,857,627 A 1/1999 Horwell et al.
5,861,143 A 1/1999 Peterson et al.
5,869,075 A 2/1999 Krzysik
5,871,763 A 2/1999 Luu et al.
5,882,573 A 3/1999 Kwok et al.
5,885,416 A 3/1999 Marinack et al.
5,885,418 A 3/1999 Anderson et al.
5,885,697 A 3/1999 Krzysik et al.
5,893,965 A 4/1999 Trokhan et al.
5,897,745 A 4/1999 Ampulski et al.
5,902,540 A 5/1999 Kwok
5,904,298 A 5/1999 Kwok et al.
5,904,809 A 5/1999 Rokman et al.
5,925,469 A 7/1999 Gee
5,932,068 A 8/1999 Farrington, Jr. et al.
5,935,381 A 8/1999 Trokhan et al.
5,935,383 A 8/1999 Sun et al.
5,954,921 A 9/1999 Dahmen et al.
5,968,853 A 10/1999 Kelly et al.
5,972,813 A 10/1999 Polat et al.
5,981,681 A 11/1999 Czech
5,985,434 A 11/1999 Qin et al.
5,990,377 A 11/1999 Chen et al.
6,010,598 A 1/2000 Boutilier et al.
6,017,417 A 1/2000 Wendt et al.
6,027,611 A 2/2000 McFarland et al.
6,030,675 A 2/2000 Schroeder et al.
D421,528 S 3/2000 Shakora
6,033,723 A 3/2000 Kistler et al.
6,054,020 A 4/2000 Goulet et al.
6,073,861 A 6/2000 Wright et al.
6,077,375 A 6/2000 Kwok
6,080,686 A 6/2000 Floyd
6,090,885 A 7/2000 Kuo et al.
6,096,169 A 8/2000 Hermans et al.
6,103,060 A 8/2000 Munerelle et al.
6,103,063 A 8/2000 Oriaran et al.
6,103,128 A 8/2000 Koso et al.
6,120,784 A 9/2000 Snyder, Jr.
6,126,784 A 10/2000 Ficke et al.
6,132,803 A 10/2000 Kelly et al.
6,136,147 A 10/2000 Edwards et al.
6,143,135 A 11/2000 Hada et al.
6,149,768 A 11/2000 Hepford
6,149,769 A 11/2000 Mohammadi et al.
6,179,961 B1 1/2001 Ficke et al.
6,183,814 B1 2/2001 Nangeroni et al.
6,197,154 B1 3/2001 Chen et al.
6,217,707 B1 4/2001 Garvey et al.
6,217,940 B1 4/2001 Kuni
6,224,714 B1 5/2001 Schroeder et al.
6,231,719 B1 5/2001 Garvey et al.
6,238,518 B1 5/2001 Rokman et al.
6,238,682 B1 5/2001 Klofta et al.
6,261,580 B1 7/2001 Lehrter et al.
6,274,667 B1 8/2001 Shannon et al.
6,287,418 B1 9/2001 Schroeder et al.
6,306,408 B1 10/2001 Eichhorn et al.
6,315,866 B1 11/2001 Sanchez
6,319,365 B1 11/2001 Inoue
6,322,604 B1 11/2001 Midkiff
6,332,952 B1 12/2001 Hsu et al.
6,365,667 B1 4/2002 Shannon et al.
6,379,498 B1 4/2002 Burns et al.
6,395,957 B1 5/2002 Chen et al.
6,423,183 B1 7/2002 Goulet et al.
6,432,268 B1 8/2002 Burghardt
6,432,270 B1 * 8/2002 Liu et al. ..... 162/164.4
6,458,243 B1 10/2002 Jones et al.
6,461,476 B1 10/2002 Goulet et al.
6,488,812 B1 12/2002 Shannon et al.
6,514,383 B1 2/2003 Liu et al.
6,547,928 B1 4/2003 Barnholtz et al.
6,582,560 B1 6/2003 Runge et al.
6,599,394 B1 7/2003 Liu et al.
6,607,783 B1 8/2003 Vander Heiden et al.
6,706,410 B1 3/2004 Horenziak et al.
6,716,309 B1 4/2004 Chuang et al.
2002/0092635 A1 7/2002 Capizzi
2002/0162243 A1 11/2002 Runge et al.
2003/0032352 A1 2/2003 Chang et al.
2003/0056917 A1 3/2003 Jimenez
2003/0077314 A1 4/2003 Shannon et al.
2003/0118848 A1 6/2003 Liu
2003/0159786 A1 8/2003 Runge et al.
2003/0188839 A1 10/2003 Urscheler
2003/0188841 A1 10/2003 Buder et al.
2003/0221808 A1 12/2003 Capizzi
2004/0074622 A1 4/2004 Liu et al.
2004/0084164 A1 5/2004 Shannon et al.
2004/0084165 A1 5/2004 Shannon et al.
2004/0086727 A1 5/2004 Flugge et al.
2004/0118532 A1 6/2004 Sarbo et al.
2004/0118533 A1 6/2004 Shannon et al.
2004/0144507 A1 7/2004 Shannon et al.

FOREIGN PATENT DOCUMENTS

EP 0 120 472 A1 10/1984
EP 0 195 458 A1 9/1986
EP 0 098 362 B1 4/1989
EP 0 333 212 A2 9/1989
EP 0 336 439 A2 10/1989
EP 0 347 153 A2 12/1989
EP 0 350 277 A 1/1990
EP 0 347 177 B2 5/1995
EP 0 347 154 B1 1/1996
EP 0 643 083 B1 5/1997
EP 0 347 176 B2 7/1997
EP 1 023 863 A1 8/2000
EP 0 708 860 B1 11/2000
EP 1 059 032 A1 12/2000
EP 1 149 947 A2 10/2001
EP 1 236 827 A1 9/2002
FR 2715052 A1 7/1999
GB 1372787 11/1974
WO WO 97/04171 A1 2/1997
WO WO 98/40425 9/1998
WO WO 99/05358 2/1999
WO WO 99/13158 A1 3/1999
WO WO 99/19081 A1 4/1999
WO WO 9934057 A1 * 7/1999
WO WO 99/55962 11/1999

| | | | |
|---|---|---|---|
| WO | WO 00/04233 | | 1/2000 |
| WO | WO 00/15907 | A1 | 3/2000 |
| WO | WO 00/71177 | A1 | 11/2000 |
| WO | WO 00/77303 | | 12/2000 |
| WO | WO 01/14631 | | 3/2001 |
| WO | WO 01/28337 | A2 | 4/2001 |
| WO | WO 01/29312 | | 4/2001 |
| WO | WO 01/29315 | A1 | 4/2001 |
| WO | WO 01/49937 | A1 | 7/2001 |
| WO | WO 02/48457 | A | 6/2002 |
| WO | WO 2004/044318 | A2 | 5/2004 |

OTHER PUBLICATIONS

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp 1-3.

TAPPI Official Method T 411 om-89, "Thickness (Caliper) of Paper, Paperboard, and Combined Board," published by the TAPPI Press, Atlanta, Georgia, revised 1989, pp. 1-3.

Derwent World Patent Database abstract of JP 06-270361 A: Description of New OJI Paper Co. Ltd., "Strainer Bag."

Luo, Yingwu and F. Joseph Schork, "Emulsion Copolymerization of Butyl Acrylate With Cationic Monomer Using Interfacial Redox Initiator System," *Journal of Polymer Science: Part A: Polymer Chemistry*, vol. 39, 2001, pp. 2696-2709.

Yan, Zegui et al., Synthesis and Characterization of Cationic Copolymers of Butylacrylate and [3-(Methacryloylamino)-propyl]trimethylammonium Chloride, *Journal of Polymer Science, Part A: Polymer Chemistry*, vol. 39, 2001, pp. 1031-1039.

TAPPI Official Test Method T 530 pm-89, "Size Test for Paper By Ink Resistance (Hercules Method)," published by the TAPPI Press, Atlanta, Georgia, revised 1989, pp. 1-5.

"Recent Developments in Foam Application Systems," Gaston County Environmental Systems, Gaston Systems brochure, 4 pages.

Camp Jr., J.G., "Recent Developments in Foam Application Systems," *Journal of Coated Fabrics*, vol. 19, Apr. 1990, pp. 252-260.

Camp Jr., J.G., "Recent Developments in Foam Application Systems," *The Indian Textile Journal*, vol. 100/12, Sep. 1990, pp. 140-143.

* cited by examiner

SOFT TISSUE HYDROPHILIC TISSUE PRODUCTS CONTAINING POLYSILOXANE AND HAVING UNIQUE ABSORBENT PROPERTIES

BACKGROUND OF THE INVENTION

In the manufacture of tissue products, such as facial tissue, bath tissue, paper towels, dinner napkins and the like, a wide variety of product properties are imparted to the final product through the use of chemical additives. One common attribute imparted to tissue sheets through the use of chemical additives is softness. There are two types of softness that are typically imparted to tissue sheets through the use of chemical additives. The two types are bulk softness and topical or surface softness.

Bulk softness may be achieved by a chemical debonding agent. Such debonding agents are typically quaternary ammonium entities containing long chain alkyl groups. The cationic quaternary ammonium entity allows for the agent to be retained on the cellulose via ionic bonding to anionic groups on the cellulose fibers. The long chain alkyl groups provide softness to the tissue sheet by disrupting fiber-to-fiber hydrogen bonds within the tissue sheet.

Such disruption of fiber-to-fiber bonds provides a two-fold purpose in increasing the softness of the tissue sheet. First, the reduction in hydrogen bonding produces a reduction in tensile strength thereby reducing the stiffness of the tissue sheet. Secondly, the debonded fibers provide a surface nap to the tissue sheet enhancing the "fuzziness" of the tissue sheet. This tissue sheet fuzziness may also be created through use of creping as well, where sufficient interfiber bonds are broken at the outer tissue surface to provide a plethora of free fiber ends on the tissue surface.

A multi-layered tissue structure may be utilized to enhance the softness of the tissue sheet. In this embodiment, a thin layer of strong softwood fibers is used in the center layer to provide the necessary tensile strength for the tissue product. The outer layers of such structures may be composed of the shorter hardwood fibers, which may or may not contain a chemical debonder.

The topical or surface softness of a tissue sheet, and ultimately the resulting tissue product, may be achieved by topically applying an emollient to the surface of the tissue sheet or tissue product. One such emollient is polysiloxane. Polysiloxane treated tissues are described in U.S. Pat. No. 4,950,545, issued on Aug. 21, 1990 to Walter et al.; U.S. Pat. No. 5,227,242, issued on Jul. 13, 1993 to Walter et al.; U.S. Pat. No. 5,558,873, issued on Sep. 24, 1996 to Funk et al.; U.S. Pat. No. 6,054,020, issued on Apr. 25, 2000 to Goulet et al.; U.S. Pat. No. 6,231,719, issued on May 15, 2001 to Garvey et al.; and, U.S. Pat. No. 6,432,270, issued on Aug. 13, 2002 to Liu et al., which are incorporated by reference to the extent that they are non-contradictory herewith. A variety of substituted and non-substituted polysiloxanes may be used.

While polysiloxanes may provide improved softness in a tissue sheet, there may be some drawbacks to their use. First, polysiloxanes may be relatively expensive. Only polysiloxane on the outermost surface of the tissue sheet may contribute to topical or surface softness of the tissue sheet. Polysiloxane present within the z-direction of the tissue sheet is believed to contribute only to bulk softness, i.e., its ability to impact softness is dependent only on its ability to reduce interfiber hydrogen bonding. Interfiber hydrogen bonding may be more efficiently controlled with traditional quaternary ammonium debonding agents. When topically applied, many polysiloxanes are effective in providing surface softness to the tissue sheet. However, such polysiloxanes may also tend to be poorly retained in the wet end of the tissue making process and hence are not suitable for use in wet end applications. Topical application typically requires significant capital expense or machine modifications to employ in existing processes not set to employ topical application of polysiloxanes. Hence, there is interest in finding an effective topical polysiloxane application to a formed tissue sheet.

Polysiloxanes are also generally hydrophobic, that is, they tend to repel water. Tissue sheets or tissue products treated with polysiloxane tend to be less absorbent than tissue sheet or tissue products not containing polysiloxanes. Hydrophilic polysiloxanes are known in the art, however, such hydrophilic polysiloxanes are typically more water soluble and hence when applied to a tissue sheet will tend to migrate more in the z-direction of the sheet than the hydrophobic polysiloxanes. Hydrophilic polysiloxanes typically are also usually sold at a cost premium to the hydrophobic polysiloxanes. Hydrophilic polysiloxanes also tend to be less effective at softening and more costly to use than hydrophobic polysiloxanes. In the wet end of the tissue making process, such hydrophilic polysiloxanes are even more poorly retained on the pulp fibers than the hydrophobic polysiloxanes due to the water solubility.

Therefore, there is a need for improving the absorbency of tissue sheets containing hydrophobic polysiloxanes. There is also a need to be able to incorporate hydrophobic polysiloxanes in the wet end of the tissue making process, avoiding the need for down stream application equipment on the tissue machine. There is also a need to minimize the z-directional penetration of a polysiloxane so as to improve softness of the tissue sheet containing lower levels of the polysiloxane. By minimizing the z-directional penetration of the polysiloxane, more polysiloxane is available on the surface of the tissue sheet, thereby providing a better topical or surface softness of the tissue sheet at lower levels of polysiloxane.

There is an interest in designing economical absorbent soft tissue products containing polysiloxane. There is also an interest in improving the topical or surface softness of tissue sheets by applying a polysiloxane to the surface of a tissue sheet in a manner that minimizes the z-directional penetration of the polysiloxane. There is also an interest in incorporating hydrophobic polysiloxanes into a tissue sheet in a manner that may avoid the need for topical treatment to a formed tissue sheet while minimizing the hydrophobicity impact on the tissue sheet.

SUMMARY OF THE INVENTION

In co-pending U.S. patent application Ser. No. 09/802,529 filed on Apr. 3, 2001 by Runge, et. al., a method for preparing fibers containing hydrophobic entities, including hydrophobic polysiloxanes, at a pulp mill is disclosed. These so called "polysiloxane pretreated pulp fibers" may then be re-dispersed in the wet end of a paper-making process to manufacture tissue sheets or the resulting tissue products containing polysiloxane. It has been found that pulp fibers treated with polysiloxane and dried prior to being re-dispersed and formed into a tissue sheet may demonstrate excellent retention of the polysiloxane through the tissue making process. Furthermore, it has also been found that a polysiloxane which may be desorbed from the pulp fibers in the tissue making process may have little to no tendency to be adsorbed by untreated pulp fibers.

Unfortunately, use of such pretreated pulp fibers in tissue products may lead to undesirable high levels of hydrophobicity in certain tissue sheets even when low levels of a polysiloxane are used. In certain cases, the degree of hydrophobicity introduced into the tissue sheet using polysiloxane pretreated pulp fibers is greater than when the same level of polysiloxane is topically applied to the tissue sheet by the application methods known in the art. It has now been discovered that the hydrophobicity associated with use of pulp fibers pretreated with hydrophobic polysiloxanes may be overcome by altering the layer structure of the tissue sheet. More specifically, by concentrating the polysiloxane pretreated pulp fibers towards the exterior of the tissue sheet surface the hydrophobicity limitations of using polysiloxane pretreated pulp fibers in absorbent tissue sheets may be overcome. Furthermore, this effect is independent of the total amount of polysiloxane in the tissue sheet or the total amount of polysiloxane in a given layer of the tissue sheet. Furthermore, when the tissue sheets are prepared in this manner, the tissue products manufactured from such tissue sheets may possess high z-directional polysiloxane gradients that allows for softer tissue products to be obtained at lower levels of polysiloxanes being utilized. Thus, soft, economical, absorbent tissue sheets containing polysiloxanes may be more easily prepared.

According to one embodiment, the present invention is a soft, absorbent, single or multi-ply layered tissue product wherein one or more of the layers of at least one of the tissue sheets forming the plies of the tissue product comprise polysiloxane pretreated pulp fibers. The layer or layers comprised of polysiloxane pretreated pulp fibers are adjacent to the layer or layers of the tissue sheet that is comprised of fibers not pretreated with polysiloxane. In another embodiment of the present invention, the tissue product is a multi-ply tissue product comprised of at least two tissue sheets. At least one of the tissue sheets is a multi-layered structure. At least one of the outer layers may be comprised of polysiloxane pretreated pulp fibers. In some embodiments, both outer layers of the tissue sheet may be comprised of polysiloxane pretreated pulp fibers. According to some of the embodiments of the present invention, there may be a z-directional polysiloxane gradient in the tissue sheet comprising the polysiloxane pretreated pulp fibers. In some embodiments it is desirable to have the z-directional polysiloxane gradient arranged such that the outer surfaces of the tissue product have higher levels of polysiloxane than the inner areas of the tissue product.

While the tissue sheets of the present invention may be applicable to any layered tissue sheet, particular interest may be in tissue and towel products. It is understood that the term "tissue sheet" as used herein refers to tissue and towel sheets. The term "tissue product" as used herein refers to tissue and towel products. Tissue and towel products as used herein are differentiated from other paper products in terms of their bulk. The bulk of the tissue and towel products of the present invention is calculated as the quotient of the caliper (hereinafter defined), expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue and towel products which tend to have much higher calipers for a given basis weight. The tissue and towel products of the present invention may have a bulk of about 2 $cm^3/g$ or greater, more specifically about 2.5 $cm^3/g$ or greater, and still more specifically about 3 $cm^3/g$ or greater.

The term "layered tissue sheet" as used herein refers to the formation of a stratified tissue sheet, wherein a particular tissue sheet or tissue sheets making up a multi-ply tissue product contain a z-directional fiber gradient. In one method of the formation of a layered tissue sheet, individual slurries of pulp fibers are sent to a divided headbox and applied to a moving belt where the pulp fibers are dewatered by any of a variety of processes and further dried to form a tissue sheet that has a specific distribution of fibers in the z-direction based on the split of the individual furnishes. Two or more layers may be present in a given tissue sheet of a multi-ply tissue product. The term "non-treated pulp fibers" as used herein refers to pulp fibers that have not been pretreated with a polysiloxane of the present invention. It is understood that the pulp fibers may be treated with other chemical additives used in tissue making processes. Where it is states that a tissue sheet or a layer of a tissue sheet is comprised of or otherwise contains non-treated pulp fibers or is free of or otherwise does not contain polysiloxane pretreated pulp fibers, it is understood that about 30 or less percent of the total amount of polysiloxane pretreated pulp fibers in the tissue sheet is present in the given tissue sheet or layer of the tissue sheet being described unless specifically disclosed otherwise. Where it states that a tissue sheet or a layer of a tissue sheet is comprised of or otherwise contains polysiloxane pretreated pulp fibers, it is understood that about 70 percent or greater of the total amount of polysiloxane pretreated pulp fibers in the tissue sheet is present in the given tissue sheet or layer of the tissue sheet being described unless specifically disclosed otherwise.

The particular structure of the polysiloxanes of the present invention may provide the desired product properties to the tissue sheet and/or tissue product. Polysiloxanes encompass a very broad class of compounds. They are characterized in having a backbone structure:

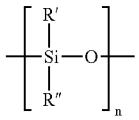

where R' and R" may be a broad range of organo and non-organo groups including mixtures of such groups and where n is an integer ≧2. These polysiloxanes may be linear, branched, or cyclic. They may include a wide variety of polysiloxane copolymers containing various compositions of functional groups, hence, R' and R" actually may represent many different types of groups within the same polymer molecule. The organo or non-organo groups may be capable of reacting with pulp fibers to covalently, ionically or hydrogen bond the polysiloxane to the pulp fibers. These functional groups may also be capable of reacting with themselves to form crosslinked matrixes with the pulp fibers. The scope of the present invention should not be construed as limited by a particular polysiloxane structure so long as that polysiloxane structure delivers the aforementioned product benefits to the tissue sheet and/or the final tissue product.

While not wishing to be bound by theory, the softness benefits that polysiloxanes deliver to pulp fibers pretreated with the polysiloxanes of the present invention may be, in part, related to the molecular weight of the polysiloxane. Viscosity is often used as an indication of molecular weight of the polysiloxane as exact number average or weight average molecular weights may be difficult to determine. The viscosity of the polysiloxanes of the present invention may be about 25 centipoise or greater, more specifically about 50 centipoise or greater, and most specifically about 100 centipoise or greater. The term "viscosity" as referred to herein refers to the viscosity of the neat polysiloxane itself and not to the viscosity of an emulsion if so delivered. It should also be understood that the polysiloxanes of the present invention may be delivered as solutions containing diluents. Such diluents may lower the viscosity of the polysiloxane solution below the limitations set above, however, the efficacious part of the polysiloxane should conform to the viscosity ranges given above. Examples of such diluents include but is not limited to oligomeric and cyclo-oligomeric polysiloxanes such as octamethylcyclotetrasiloxane, octamethyltrisiloxane, decamethylcyclopentasiloxane, decamethyltetrasiloxane and the like, including mixtures of these diluents.

The particular form in which the polysiloxanes of the present invention are delivered to the pulp fibers in the manufacture of the polysiloxane pretreated pulp fiber may be any form known in the art. Polysiloxanes useful for the present invention may be delivered as neat fluids; aqueous or non-aqueous solutions; aqueous or non-aqueous dispersions; and, emulsions, including microemulsions, stabilized by suitable surfactant systems that may confer a charge to the emulsion micelles. Nonionic, cationic, and anionic systems may be employed. To maximize retention of the polysiloxane during the manufacturing process of the tissue sheet, it may be desirable to add the polysiloxane to the pulp fiber as a neat fluid.

The z-directional polysiloxane gradient may be determined via X-ray photoelectron spectroscopy (XPS) as described hereinafter. Surface polysiloxane levels are reported as atomic concentration of the Si as determined by the spectrometer. The atomic Si concentration is measured to a depth of around 100 nanometers and is indicative of the polysiloxane content at the surface of the tissue sheet specimen(s). Z-directional polysiloxane gradient is defined as the percent difference in atomic Si concentration between the high polysiloxane content side and the low polysiloxane content side of a tissue sheet. The z-directional polysiloxane gradient is defined via the following equation:

$$\%\ z\text{-directional polysiloxane gradient}=(X-Y)/X*100$$

wherein X is the atomic % Si on the high content side and Y is the atomic % Si on the low content side of the layer comprising the polysiloxane pretreated pulp fibers. The higher the % of the z-directional polysiloxane gradient the more soft a tissue sheet may be at a given total polysiloxane content.

The non-treated pulp fibers used in the present invention may or may not be the same type of pulp fibers that are treated with a polysiloxane of the present invention. The polysiloxane pretreated pulp fibers of the present invention may comprise any pulp fiber type or combinations thereof, including but not limited to hardwood pulp fibers, softwood pulp fibers, or combinations thereof. The layers comprising non-treated pulp fibers may be composed of any pulp fiber type or combinations thereof, the same or different from the outer layers containing the silicone pretreated pulp, including but not limited to hardwood pulp fibers, softwood pulp fibers, or combinations thereof. It is understood that the pulp fibers comprising the non-treated pulp fibers of the present invention may or may not be the same as the polysiloxane pretreated pulp fibers or combinations thereof of the present invention.

In another embodiment, the invention may reside in a method for making a soft, economical, absorbent tissue product comprising polysiloxane pretreated pulp fibers. The method may comprise: (a) forming at least a first aqueous suspension of pulp fibers comprising polysiloxane pretreated pulp fibers; (b) forming at least a second aqueous suspension of pulp fibers comprising non-treated pulp fibers; (c) forwarding the first aqueous suspension of pulp fibers comprising polysiloxane pretreated pulp fibers to a stratified headbox having at least two outer layers and at least one inner layer such that the first aqueous suspension of pulp fibers is directed to at least one of the outer layers of the headbox; (d) forwarding the second aqueous suspension of pulp fibers comprising non-treated pulp fibers to the stratified headbox such that the second suspension of pulp fibers is directed to an inner layer; (e) depositing the first and the second aqueous suspensions of pulp fibers onto a forming fabric to form a wet layered tissue sheet; (f) dewatering the tissue sheet to form a dewatered layered tissue sheet; and, (g) drying the dewatered tissue sheet to form a dried layered tissue sheet, wherein the polysiloxane pretreated pulp fibers comprise at least an outer layer of the dried tissue sheet. The layer of the dried tissue sheet comprising the polysiloxane pretreated pulp fibers is adjacent to a layer of the dried tissue sheet comprising pulp fibers that have not been pretreated with polysiloxane. The layer of the dried tissue sheet comprising the polysiloxane pretreated pulp fibers constitutes about 50% or less, more specifically about 45% or less, and most specifically about 40% or less of the total tissue sheet weight. The tissue sheet may have a z-directional polysiloxane gradient of about 20% or greater, more specifically about 25% or greater, and still more specifically about 30% or greater.

THE DETAILED DESCRIPTION OF THE INVENTION

Figure 1:
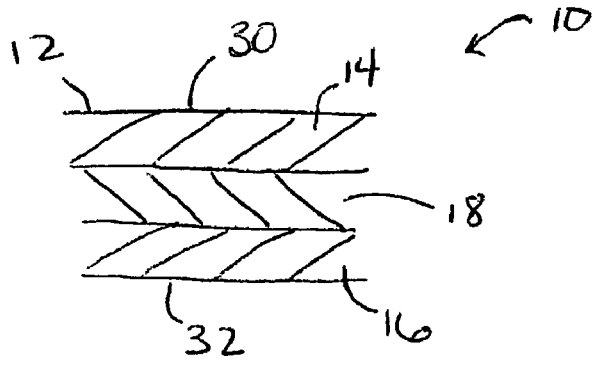
FIG. 1 is a diagram of a tissue sheet of the present invention having three layers.

As stated above, the present invention is applicable to any tissue sheet, such sheets include tissue and towel sheet and the resulting tissue and towel products. Tissue products as used herein are differentiated from other tissue products in terms of its bulk. The bulk of the tissue products of the present invention may be calculated as the quotient of the caliper (hereinafter defined), expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue products of the present invention which tend to have much higher calipers for a given basis weight. The tissue products of the present invention have a bulk of about 2 $cm^3/g$ or greater, more specifically about 2.5 $cm^3/g$ or greater, and still more specifically about 3 $cm^3/g$ or greater.

The basis weight and caliper of the multi-ply tissue products of the present invention may vary widely and may be dependent on, among other things, the number of plies (tissue sheets). The caliper and bulk of the plies comprising non-treated pulp fibers may be of any value. The caliper of the individual ply or plies comprising the polysiloxane pretreated pulp fibers may be about 1200 microns or less, more specifically about 1000 microns or less, and still more specifically about 800 microns or less. The bulk of the individual ply or plies comprising the polysiloxane pretreated pulp fibers may be about 2 g/cm$^3$ or greater, more specifically about 2.5 g/cm$^3$ or greater, and most specifically about 3 g/cm$^3$ or greater.

Pulp fibers not pretreated with polysiloxane may be blended with pulp fibers pretreated with polysiloxane in the layer or layers comprising the polysiloxane pretreated pulp fibers. The ratio of polysiloxane pretreated pulp fibers to non-treated pulp fibers in any layer of the tissue sheet comprising the polysiloxane pretreated pulp fibers may vary widely and may range from about 5% to about 100% by weight on a dry fiber basis, more specifically from about 10% to about 100% by weight on a dry fiber basis, and still most preferably from about 10% to about 90% by weight on a dry fiber basis. The total weight of polysiloxane pretreated pulp fibers relative to the total weight of the pulp fibers (both polysiloxane pretreated pulp fibers and non-treated pulp fibers) in the tissue sheet comprising the polysiloxane pretreated pulp fibers may vary widely from about 0.05% to about 80% on a dry pulp fiber basis, more specifically from about 0.2% to about 70% on a dry pulp fiber basis, and most specifically from about 0.5% to about 60% on a dry pulp fiber basis.

It is often desirable to have the polysiloxane on at least one of the outer surfaces of the tissue product. In the outer tissue sheets of a multi-ply tissue product comprising the polysiloxane pretreated pulp fibers, the total amount of polysiloxane in the tissue sheet may vary but may range from about 0.01% to about 5% by weight of the total dry pulp fiber weight of the tissue sheet, more specifically from about 0.02% to about 3% by weight of the total dry pulp fiber weight of the tissue sheet, and most preferably from about 0.03% to about 1.5% by weight of the total dry pulp fiber weight of the tissue sheet.

In a specific embodiment of the present invention, the tissue product is a multi-ply tissue product having two outer surfaces wherein both outer tissue sheets of the multi-ply product are layered tissue sheets comprising polysiloxane pretreated pulp fibers. The outer surfaces of the tissue product are comprised of layers comprising polysiloxane pretreated pulp fibers. In another specific embodiment of the present invention, the tissue product is a single ply tissue product comprising at least a 3-layer tissue sheet wherein both outer layers comprise pretreated polysiloxane pulp fibers and at least one inner layer comprises non-treated pulp fibers.

In some embodiments of the present invention, any single layer comprising the polysiloxane pretreated pulp fiber may constitute about 60% or less by weight of the tissue sheet, more specifically about 50% or less by weight of the tissue sheet, and most specifically about 45% or less by weight of the tissue sheet in which the layer is contained. In the tissue sheets comprising the polysiloxane pretreated pulp fibers, the weight of non-treated pulp fiber in layers that do not comprise polysiloxane pretreated pulp fibers constitutes about 20% or more by weight of the tissue sheet, more specifically about 30% or more by weight of the tissue sheet, and more specifically 50% by weight of the tissue sheet in which the layer is contained.

Figure 2:
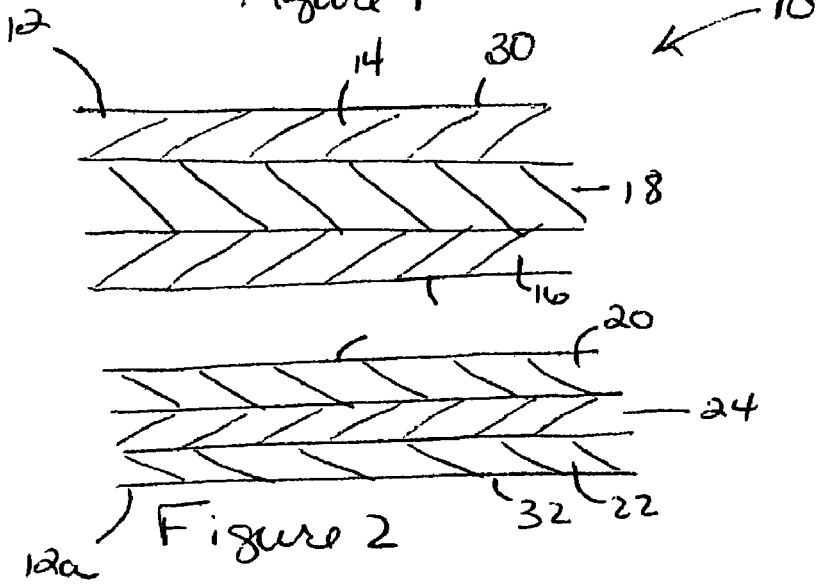
FIG. 2 is a diagram of two tissue sheets of the present invention, each tissue sheet having three layers.

One embodiment of the present invention may employ a three-layer structure. FIG. 1 shows a tissue sheet 12 consisting of a three layers 14, 16, and 18. FIG. 2 shows two outer tissue sheets 12 and 12*a* of a multi-ply tissue product 10, the outer tissue sheets 12 and 12*a* comprise three-layer structures. The layer or layers of the tissue sheets 12 and/or 12*a* containing the polysiloxane pretreated pulp fibers are adjacent to a layer not containing polysiloxane pretreated pulp fibers. The relative width of the layer or layers containing the polysiloxane pretreated pulp fibers to the width of the adjacent layer containing non-treated pulp fibers may be calculated from weight % of the pulp fiber in the layers comprising the polysiloxane pretreated pulp fibers and the weight % of non-treated pulp fibers in the adjacent layer not containing the polysiloxane pretreated pulp fibers. The weight ratios, also known as fiber splits are used to express the width of the individual layers.

Figure 3:
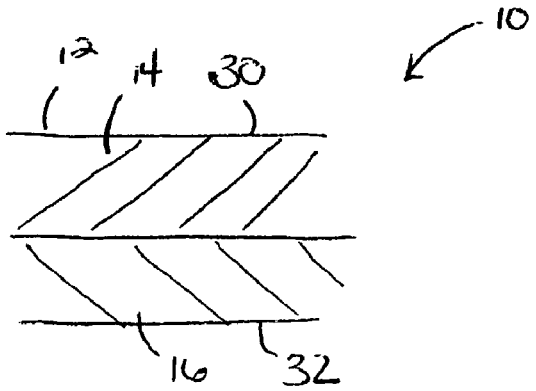
FIG. 3 is a diagram of a tissue sheet of the present invention having two layers.

Single or multiply tissue products 10 may be made from layered tissue sheets 12. Referring to FIG. 1, in a single ply layered tissue product 10, the polysiloxane pretreated pulp fibers may lie in the first outer layer 14 or the second layer outer 16 or both the first and second outer layers 14 and 16 of the tissue sheet 12 of the tissue product 10. In one embodiment of a single ply tissue product 10, the polysiloxane pretreated pulp fibers are positioned in the first and second outer layers 14 and 16 while the inner layer 18 comprises pulp fibers not pretreated with polysiloxane. In another embodiment of a single ply tissue product 10, the polysiloxane pretreated pulp fibers are positioned in one of the first and second outer layers 14 and 16 while the inner layer 18 comprises pulp fibers not pretreated with polysiloxane and the other outer layer 16 or 14 comprises non-treated pulp fibers. In another embodiment of the present invention, as shown in FIG. 3, in a two layer single-ply tissue product 10, the polysiloxane pretreated pulp fibers are positioned in only one of the first and second outer layers 14 or 16 while the other outer layer 16 or 14 would comprise non-treated pulp fibers. In such a two layered embodiment, the inner layer 18 is understood not to be present in the two layered single tissue sheet 12.

Referring to FIG. 2, in multi-ply tissue products 10, the polysiloxane pretreated pulp fibers may be positioned in at least one of the outer first layers 14 and 22 of the tissue sheets 12 and 12*a* which form the outer surfaces 30 and 32, respectively, of a multi-ply tissue product 10. In another embodiment of the present invention, the polysiloxane pretreated pulp fibers may be positioned in the first outer layers 14 and 22 of the tissue sheets 12 and 12*a*, respectively, which form the outer surfaces 30 and 32 of the multi-ply tissue product 10. It should also be recognized that FIG. 2 represents only the outer tissue sheets 12 and 12*a* of the multi-ply tissue product 10. Any number of additional tissue sheets 12 may be contained between the two outer sheets 12 and 12*a*. Additional tissue sheets 12 may or may not contain polysiloxane pretreated pulp fibers. The tissue sheets 12 comprising non-treated pulp fibers may be layered or non-layered.

In some embodiments of the present invention, it is understood that the discussion of first outer layers 14 and 22 may also be applied to the second outer layers 16 and 20 as shown in FIG. 2. Additionally, in some embodiments of the present invention, the discussion of the first outer layers 14 and 22, the second outer layers 16 and 20, and the inner layers 18 and 24 may be applied to additional tissue sheets 12 that may be incorporated into multi-ply tissue products 10.

It is understood that tissue sheet 12 may or may not be the same as tissue sheet 12*a*, but the designation of 12 and 12*a* is provided to more clearly differentiate between the various tissue sheets 12 within the multi-ply tissue products 10 the present invention. It is also understood that the tissue sheets 12 (and tissue sheets 12 and 12*a*) of the present invention may or may not be the same as in that the tissue sheets 12 (or tissue sheets 12 and 12*a*) may comprise different pulp types and/or different percents of pulp types and of polysiloxane pretreated pulp fibers to non-treated pulp fibers.

In another embodiment of the present invention, a multi-ply tissue product 10 may have the polysiloxane pretreated pulp fibers positioned in first outer layers 14 and 22 of the two outer tissue sheets 12 and 12*a* while at least one of the inner layer or layers 16, 18, 20, and 24 of the tissue sheets 12 and 12*a* are comprised of pulp fibers not pretreated with polysiloxane. In another embodiment of the present invention, a multi-ply tissue product 10 may have the polysiloxane pretreated pulp fibers positioned in first outer layers 14 and 22 and in the second outer layers 16 and 20 of the two outer tissue sheets 12 and 12*a* while the inner layer or layers 18 and 24 of the tissue sheets 12 and 12*a* may be comprised of non-treated pulp fibers.

In some embodiments of the present invention, it is desirable in the tissue product 10 to position the outer layer or layers (for example, outer layers 14 and/or 22 as shown in FIG. 2 or outer layers 14 and/or 16 as shown in FIG. 1) comprising polysiloxane pretreated pulp fibers of the tissue sheets 12 and/or 12*a* such that the outer layer or layers 14 and/or 22 (or alternatively, outer layers 14 and/or 16) comprising the polysiloxane pretreated pulp fibers are adjacent to an inner layer (for example, inner layers 18 and/or 24 as shown in FIG. 2 or inner layer 18 as shown in FIG. 1) comprising non-treated pulp fibers. In another embodiment of the present invention, one of the first and second outer layers 14 and 16 of the layered single ply tissue product 10 may comprise polysiloxane pretreated pulp fibers while the other outer layer 16 or 14 comprises non-treated pulp fibers and is adjacent the outer layer 14 or 16 comprising the polysiloxane pretreated pulp fibers.

In some embodiments of the present invention, it is desirable to produce a tissue sheet 12 wherein the depth of any one of the first outer layer 14 and 22 as shown in FIG. 2 or the first and second outer layers 14 and 16 as shown in FIG. 1 comprising polysiloxane pretreated pulp fiber not exceed a predetermined depth ratio relative to the total depth (or caliper) of the tissue sheet 12 (or 12*a*). The depth of at least one outer layer (14 and 22 as shown in FIGS. 2 or 14 and 16 as shown in FIG. 1) of a tissue sheet 12 (or 12*a*) relative to the total depth of the tissue sheet 12 (or 12*a*) is determined from the weight ratio of the outer layer (14 or 22 as shown in FIG. 2 or 14 or 16 as shown in FIG. 1) comprising the polysiloxane pretreated pulp fibers relative to the total weight of the tissue sheet 12 (or 12*a*). Such a calculation may be referred to as the fiber split. For example, a three layered tissue sheet 12, such as shown in FIG. 1, may have a fiber split of a about 30/40/30 northern hardwood kraft (NHWK) pulp fibers/northern softwood kraft (NSWK) pulp fibers/NHWK pulp fibers will have a construction wherein about 30% by weight of the total weight of the tissue sheet 12 comprises NHWK pulp fibers located in one of the outer layers 14 or 16 of the tissue sheet 12, about 40% by weight of the total weight of the tissue sheet 12 comprises NSWK pulp fibers located in the inner layer 18 of the tissue sheet 12, and about 30% by weight of the total weight of the tissue sheet 12 comprises NHWK pulp fibers located in the other outer layer 16 or 14 of the tissue sheet 12.

The absorbency of the tissue product 10 and/or tissue sheet 12 may be determined by the Wet Out Time. As used herein, the term "Wet Out Time" is related to absorbency and is the time it takes for a given sample of a tissue sheet 12 to completely wet out when placed in water. The Wet Out Time (hereinafter defined) for treated tissue sheets 12 of the present invention may be about 240 seconds or less, more specifically about 150 seconds or less, still more specifically about 120 seconds or less, and still more specifically about 90 seconds or less.

In a multi-ply tissue product 10, the overall orientation of the tissue sheets 12 and 12*a* relative to one another may be varied. However, as polysiloxane treatments are typically applied to improve topical or surface softness of a tissue sheet 12 or finished tissue product 10, one embodiment of a multi-ply tissue product 10 of the present invention has at least one outer surface 30 and/or 32 comprising layers (for example 14 and/or 22 as shown in FIGS. 2 or 14 and/or 16 as shown in FIG. 1) comprising the polysiloxane pretreated pulp fibers, thereby placing at least one layer of the tissue sheets 12 and 12*a* comprising a high or the highest level of polysiloxane outwardly facing so as to be on the outer surface 30 and/or 32 contacting the user's skin. In other embodiments of the present invention wherein the multi-ply tissue products 10 comprising more than two tissue sheets 12, polysiloxane pretreated pulp fibers may be present in one or more of the tissue sheets 12. In some of these embodiments, a z-directional polysiloxane gradient may be present in at least one of the tissue sheets 12. It may be desirable to have the z-directional polysiloxane gradient in more than one of the tissue sheets 12 and/or 12*a*. In one embodiment of the present invention, the structure of the tissue product 10 comprises at least two tissue sheets 12 and 12*a*, wherein the layers 14 and 22 comprise polysiloxane pretreated pulp fibers, thus having the highest levels of polysiloxane forming the outer surfaces 30 and 32 of the tissue product 10. In this embodiment of the present invention, the inner tissue layers comprise non-treated pulp fibers.

In another embodiment of the present invention, the tissue product 10 may comprise hardwood and softwood kraft pulp fibers. In other embodiments of the present invention, at least one tissue sheet 12 may comprise hardwood and softwood kraft pulp fibers. It may be desirable in some embodiments for the polysiloxane pretreated pulp fibers to comprise hardwood kraft pulp fibers. It may also be desirable in some embodiments of the present invention to position the polysiloxane pretreated pulp fibers comprised of hardwood kraft pulp fibers in at least one of the outer layers of the tissue sheets 12 that form the outer surfaces 30 and/or 32 of the tissue product 10. In variations of this embodiment of the present invention, the remaining layers of the tissue sheets 12 of the tissue product 10 may or may not comprise polysiloxane pretreated pulp fibers, the order of the layers and/or tissue sheets 12 may be varied in any order. Any number of additional layers and/or tissue sheets 12 may be employed in the tissue product 10 of the present invention. More specifically, according to one embodiment, the tissue product 10 is a single ply product. The tissue sheet 12 has a structure comprised of three layers 14, 16, and 18. The first outer layer 14 comprises polysiloxane pretreated pulp fibers comprised of hardwood kraft pulp fibers, forming the outer surface 30 of the tissue product 10. The inner layer 18 comprises softwood kraft pulp fibers not-pretreated with polysiloxane. The second outer layer 16 comprises non-treated pulp fibers comprised of hardwood kraft pulp fibers, forming the outer surface 32 of the tissue product 10. In another embodiment of the present invention, the tissue sheet 12 has a structure comprised of three layers 14, 16, and 18. The first outer layer 14 comprises polysiloxane pretreated pulp fibers comprised of hardwood kraft pulp fibers, forming the outer surface 30 of the tissue product 10. The inner layer 18 comprises non-treated pulp fibers comprised of hardwood kraft pulp fibers. The second outer layer 16 comprises non-treated pulp fibers comprised of softwood kraft pulp fibers, forming the outer surface 32 of the tissue product 10.

In another embodiment of the present invention, the single ply tissue product 10 may comprise a three-layer tissue sheet 12 wherein the first and second outer layers 14 and 16, as shown in FIG. 1, comprise polysiloxane pretreated pulp fibers and the inner layer 18 comprises non-treated pulp fibers. The structure of the tissue sheet 12 may be arranged such that there is the z-directional polysiloxane gradient of the tissue sheet 12 measured from the outer surface 30 to the outer surface 32 of the tissue sheet 12 wherein the polysiloxane content decreases at the center 40 of the tissue sheet 12 and increases at or adjacent the outer surfaces 30 and 32 of the tissue sheet 12. In some of the embodiments of the present invention, the inner layer 18 of the three-layer tissue sheet 12 of the single ply tissue product 10 has a polysiloxane content of about 0%.

In some of the embodiments of the present invention, the tissue products 10 may have a high z-directional polysiloxane gradient in the outer layer or layers 12 of the tissue product 10. The present invention may comprise a soft, absorbent single or multi-ply tissue product 10. Each tissue sheet 12 of the tissue product 10 have an outer surface 42 and an opposing outer surface 44. One or more of the tissue sheets 12 of the multi-ply tissue product 10 contains a polysiloxane wherein the polysiloxane is distributed non-uniformly in the z-direction of the tissue sheet 12. As one example, the level of polysiloxane on or adjacent the outer surface 42 of the tissue sheet 12 as measured in terms of atomic % Si is different from the atomic % Si on or adjacent the opposing outer surface 44 of the tissue sheet 12. The atomic % Si on the surface comprising the highest atomic % Si may be about 3% or greater, more specifically about 4% or greater, and most specifically about 5% or greater. The z-directional polysiloxane gradient, as calculated by the equation above and as defined above, between the outer surfaces 42 and 44 is about 20%, more specifically about 25% or greater, still more specifically about 30% or greater, and most specifically about 35% or greater.

Pulp Fibers:

A wide variety of natural and synthetic pulp fibers are suitable for use in the tissue sheets 12 and tissue products 10 of the present invention. The pulp fibers may include fibers formed by a variety of pulping processes, such as kraft pulp, sulfite pulp, thermomechanical pulp, etc. In addition, the pulp fibers may consist of any high-average fiber length pulp, low-average fiber length pulp, or mixtures of the same. Any of the natural pulp fibers species may be pretreated with the polysiloxane of the present invention.

One example of suitable high-average length pulp fibers includes softwood kraft pulp fibers. Softwood kraft pulp fibers are derived from coniferous trees and include pulp fibers such as, but not limited to, northern softwood, southern softwood, redwood, red cedar, hemlock, pine (e.g., southern pines), spruce (e.g., black spruce), combinations thereof, and the like. Northern softwood kraft pulp fibers may be used in the present invention. One example of commercially available northern softwood kraft pulp fibers suitable for use in the present invention include those available from Kimberly-Clark Corporation located in Neenah, Wis. under the trade designation of "Longlac-19".

Another example of suitable low-average length pulp fibers are the so called hardwood kraft pulp fibers. Hardwood kraft pulp fibers are derived from deciduous trees and include pulp fibers such as, but not limited to, eucalyptus, maple, birch, aspen, and the like. In certain instances, eucalyptus kraft pulp fibers may be particularly desired to increase the softness of the tissue sheet. Eucalyptus kraft pulp fibers may also enhance the brightness, increase the opacity, and change the pore structure of the tissue sheet to increase its wicking ability. Moreover, if desired, secondary pulp fibers obtained from recycled materials may be used, such as fiber pulp from sources such as, for example, newsprint, reclaimed paperboard, and office waste.

In some embodiments of the present invention, the polysiloxane pretreated pulp fibers within at least one outer layer (such as 14 and/or 16 as shown in FIGS. 1 and 14 and/or 22 as shown in FIG. 2) may be comprised of hardwood kraft pulp fibers, of softwood kraft pulp fibers, or a blend of hardwood and softwood kraft pulp fibers. In one embodiment of the present invention, the length of the polysiloxane pretreated pulp fibers may be of low average length and comprising hardwood kraft pulp fibers. In some embodiments, the polysiloxane pretreated pulp fibers may be of a single species such as eucalyptus, maple, birch, aspen or blends of various hardwood pulp fiber species thereof. In some embodiments of the present invention, at least one outer layer (such as 14 and/or 16 as shown in FIGS. 1 and 14 and/or 22 as shown in FIG. 2) may be comprised of polysiloxane pretreated pulp fibers comprised primarily of hardwood kraft pulp fibers. In other embodiments of the present invention, the outer layers (such as 14 and/or 16 as shown in FIGS. 1 and 14 and/or 22 as shown in FIG. 2) may be comprised of polysiloxane pretreated pulp fibers comprised of hardwood kraft pulp fibers which may be blended with softwood kraft pulp fibers that may be polysiloxane pretreated pulp fibers, non-treated pulp fibers, or a blend of polysiloxane pretreated pulp fibers and non-treated pulp fibers.

The overall ratio of hardwood kraft pulp fibers to softwood kraft pulp fibers within the tissue product 10, including tissue sheets 12 comprising non-treated pulp fibers may vary broadly. However, in some embodiments of the present invention, tissue product 10 may comprise a blend of hardwood kraft pulp fibers and softwood kraft pulp fibers (polysiloxane pretreated pulp fibers and/or non-treated pulp fibers) wherein the ratio of hardwood kraft pulp fibers to softwood kraft pulp fibers is from about 9:1 to about 1:9, more specifically from about 9:1 to about 1:4, and most specifically from about 9:1 to about 1:3. In one embodiment of the present invention, the hardwood kraft pulp fibers and softwood kraft pulp fibers (polysiloxane pretreated pulp fibers and/or non-treated pulp fibers) may be layered so as to give a heterogeneous distribution of hardwood kraft pulp fibers and softwood kraft pulp fibers in the z-direction of the tissue sheet 12. In another embodiment, the hardwood kraft pulp fibers (polysiloxane pretreated pulp fibers and/or non-treated pulp fibers) may be located in at least one of the outer layers (the outer layers, such as 14 and/or 16 as shown in FIG. 1 or 14 and/or 22 as shown in FIG. 2 which may form the outer surfaces 30 and 32 of the tissue product 10) of the tissue product 10 wherein at least one of the inner layers may comprise softwood kraft pulp fibers not containing polysiloxane pretreated pulp fibers.

In addition, synthetic fibers may also be utilized. The discussion herein regarding pulp fibers not pretreated with polysiloxane is understood to include synthetic fibers. Some suitable polymers that may be used to form the synthetic fibers include, but are not limited to: polyolefins, such as, polyethylene, polypropylene, polybutylene, and the like; polyesters, such as polyethylene terephthalate, poly(glycolic acid) (PGA), poly(lactic acid) (PLA), poly(β-malic acid) (PMLA), poly(ε-caprolactone) (PCL), poly(ρ-dioxanone) (PDS), poly(3-hydroxybutyrate) (PHB), and the like; and, polyamides, such as nylon and the like. Synthetic or natural cellulosic polymers, including but not limited to: cellulosic esters; cellulosic ethers; cellulosic nitrates; cellulosic acetates; cellulosic acetate butyrates; ethyl cellulose; regenerated celluloses, such as viscose, rayon, and the like; cotton; flax; hemp; and mixtures thereof may be used in the present invention. The synthetic fibers may be located in the layers of the tissue sheet 12 comprising polysiloxane pretreated pulp fibers, the layers of the tissue sheet 12 comprising non-treated pulp fibers, or in any or all layers of the tissue sheet 12. As discussed for tissue sheets 12, in multi-ply tissue products 10 of the present invention, the synthetic fibers may be located in any or all tissue sheets 12 of the multi-ply tissue product 10.

Polysiloxanes:

The particular structure of the polysiloxanes of the present invention may provide the desired product properties to the tissue sheet 12 and/or tissue product 10. Functional and non-functional polysiloxanes are suitable for use in the present invention. Polysiloxanes encompass a very broad class of compounds. They are characterized in having a backbone structure:

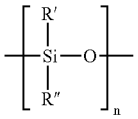

where R' and R" may be a broad range of organo and non-organo groups including mixtures of such groups and where n is an integer ≧2. These polysiloxanes may be linear, branched, or cyclic. They may include a wide variety of polysiloxane copolymers containing various compositions of functional groups, hence, R' and R" actually may represent many different types of groups within the same polymer molecule. The organo or non-organo groups may be capable of reacting with pulp fibers to covalently, ionically or hydrogen bond the polysiloxane to the pulp fibers. These functional groups may also be capable of reacting with themselves to form crosslinked matrixes with the pulp fibers. The scope of the present invention should not be construed as limited by a particular polysiloxane structure so long as that polysiloxane structure delivers the aforementioned product benefits to the tissue sheet and/or the final tissue product.

A specific class of polysiloxanes suitable for use in the present invention may have the general formula:

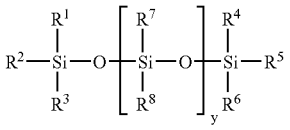

wherein the $R^1$–$R^8$ moieties may be independently any organofunctional group including $C_1$ or higher alkyl groups, aryl groups, ethers, polyethers, polyesters, amines, imines, amides, or other functional groups including the alkyl and alkenyl analogues of such groups and y is an integer >1. Specifically, the $R^1$–$R^8$ moieties may be independently any $C_1$ or higher alkyl group including mixtures of said alkyl groups. Examples of polysiloxanes that may be useful in the present invention are those in the DC-200 fluid series, manufactured and sold by Dow Corning, Inc., located in Midland, Minn.

Functionalized polysiloxanes and their aqueous emulsions are typically commercially available materials. These amino functional polysiloxanes having the general following structure may be useful in the present invention:

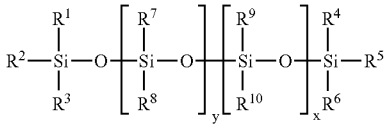

wherein, x and y are integers >0. The mole ratio of x to (x+y) may be from about 0.005 percent to about 25 percent. The $R^1$–$R^9$ moieties may be independently any organofunctional group including $C_1$ or higher alkyl groups, aryl groups, ethers, polyethers, polyesters, amines, imines, amides, or other functional groups including the alkyl and alkenyl analogues of such groups. The $R^{10}$ moiety may be an amino functional moiety including but not limited to primary amine, secondary amine, tertiary amines, quaternary amines, unsubstituted amides and mixtures thereof. In one embodiment, the $R^{10}$ moiety may comprise at least one amine group per constituent or two or more amine groups per substituent, separated by a linear or branched alkyl chain of $C_1$ or greater. Examples of some polysiloxanes that may be useful in the present invention include, but are not limited to, DC 2-8220 commercially available from Dow Corning, Inc., locate at Midland, Minn., DC 2-8182 commercially available from Dow Corning, Inc., located at Midland, Minn., and Y-14344 commercially available from Crompton, Corp., located at Greenwich, Conn.

Another class of functionalized polysiloxanes that may be suitable for use in the present invention is the polyether polysiloxanes. Such polysiloxanes may be used with other functional polysiloxanes as a means of improving hydrophilicity of the polysiloxane treated tissue products. Such polysiloxanes generally have the following structure:

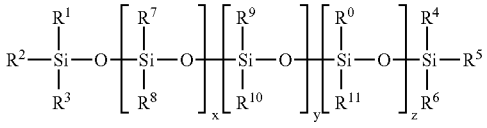

wherein, x and z are integers >0. y is an integer ≧0. The mole ratio of x to (x+y+z) may be from about 0.05 percent to about 95 percent. The ratio of y to (x+y+z) may be from about 0 percent to about 25%. The $R^0$–$R^9$ moieties may be independently any organofunctional group including $C_1$ or higher alkyl groups, aryl groups, ethers, polyethers, polyesters, amines, imines, amides, or other functional groups including the alkyl and alkenyl analogues of such groups.

The $R^{10}$ moiety may be an amino functional moiety including, but not limited to, primary amine, secondary amine, tertiary amines, quaternary amines, unsubstituted amides, and mixtures thereof. An exemplary $R^{10}$ moiety may contain one amine group per constituent or two or more amine groups per substituent, separated by a linear or branched alkyl chain of $C^1$ or greater. $R^{11}$ may be a polyether functional group having the generic formula: $—R^{12}—(R^{13}—O)_a—(R^{14}O)_b—R^{15}$, wherein $R^{12}$, $R^{13}$, and $R^{14}$ may be independently $C_{1-4}$ alkyl groups, linear or branched; $R^{15}$ may be H or a $C_{1-30}$ alkyl group; and, "a" and "b" are integers of from about 1 to about 100, more specifically from about 5 to about 30. Examples of aminofunctional polysiloxanes that may be useful in the present invention include the polysiloxanes provided under the trade designation of Wetsoft CTW family manufactured and sold by Wacker, Inc., located Adrian, Minn. Other examples of such polysiloxanes may be found in U.S. Pat. No. 6,432,270, issued on Aug. 13, 2002 to Liu, et al., the disclosure of which is incorporated herein by reference to the extent that it is non-contradictory herewith.

Polysiloxane Pretreated Pulp Fibers:

The preparation of polysiloxane pretreated pulp fibers can be accomplished by methods such as those described in co-pending U.S. patent application Ser. No. 09/802,529 filed on Apr. 3, 2001 by Runge, et. al. It has been found that pulp fibers treated with polysiloxane in this manner demonstrate excellent retention of the polysiloxane through the tissue making process. Furthermore, it has been found that a polysiloxane which may be desorbed from the fibers in the tissue making process has little to no tendency to be adsorbed by non-treated pulp fibers. The polysiloxane pretreated pulp fibers may contain from about 0.1% to about 10% polysiloxane by weight, more specifically from about 0.2% to about 4% polysiloxane by weight, and most specifically from about 0.3% polysiloxane to about 3% polysiloxane by weight. Using a stratified headbox to make a multi-layered tissue sheet comprising polysiloxane pretreated pulp fibers, the tissue sheets may be used to produce tissue products containing polysiloxane distributed non-uniformly in the z-direction of the tissue sheet.

The polysiloxane pretreated pulp fibers may be directed towards at least one of the outer surfaces 30 and 32 formed by the outer layers (such as 14 and 16 as shown in FIG. 1 or 14 and 22 as shown in FIG. 2) adjacent the outer surfaces 30 and 32 of the multi-layered tissue sheet 12. The layer of the multi-layer tissue sheet 12 comprising the polysiloxane pretreated pulp fibers may constitute about 60% or less by of the weight of the total tissue sheet, more specifically about 50% or less by weight of the total tissue sheet, and still more specifically about 45% or less by weight of the total tissue sheet. The polysiloxane pretreated pulp fibers may be blended with any of various non-treated pulp fibers before being formed into the multi-layered tissue sheet 12. The polysiloxane pretreated pulp fibers may constitute from about 5% to about 100% of the pulp fibers in the layer of the tissue sheet 12 comprising the polysiloxane pretreated pulp fibers, more specifically from about 10% to about 100% of the pulp fibers in the layer comprising the polysiloxane pretreated pulp fibers, and most specifically from about 10% to about 90% of the pulp fibers in the layer comprising the polysiloxane pretreated pulp fibers.

Methods of Application:

The polysiloxanes of the present invention may be applied to pulp fibers in accordance with any method and form so long as the claimed product benefits are not compromised. The polysiloxane may be delivered to the pulp fibers as an aqueous emulsion or dispersion, a solution in an organic fluid or non-organic fluid medium, or as a neat polysiloxane containing no added solvents, emulsifiers, or other agents.

The method by which the polysiloxane may be added to pulp fibers to form the polysiloxane pretreated pulp fibers may be any method known in the art. One method may be to dry the pulp fibers to a consistency of about 95% or greater subsequent to the application of the polysiloxane to the pulp fibers and prior to the pulp fibers being redispersed in water at the tissue machine. The polysiloxane may be added to the pulp fibers at a pulp mill. The pulp fibers may be only once dried prior to the pulp fibers being dispersed during the tissue making process. Other embodiments for adding the polysiloxanes to the pulp fibers include, but are not limited to, processes that incorporate comminuted or flash dried pulp fibers being entrained in an air stream combined with an aerosol or spray of a polysiloxane so as to treat individual pulp fibers prior to incorporation of the polysiloxane pretreated pulp fibers into the tissue sheet 12. Other embodiments involving secondary processes may be utilized with the present invention. Examples of such processes include, but are not limited to:

- Preparing a slurry of non-treated, once dried pulp fibers, dewatering and optionally drying the slurried non-treated pulp fibers to form a partially dried or dried web of non-treated pulp fibers, treating partially dried or dried web of non-treated pulp fibers with a polysiloxane to form a partially dried or dried polysiloxane pretreated pulp fiber web, further drying said partially dried or dried polysiloxane pretreated pulp fiber web to form a dried polysiloxane pretreated pulp fiber web comprising polysiloxane pretreated pulp fibers.
- Applying a polysiloxane directly to a roll of dried or partially dried non-treated pulp fibers to form a roll of polysiloxane pretreated pulp fibers.

It should be understood that while such secondary processes may be used to pretreat the pulp fibers with polysiloxane that utilizing such processes may result in undesirable issues, such as a significant economic penalty to the overall tissue product characteristics or properties.

The application of a polysiloxane to a partially dried or dried pulp fiber web to form the polysiloxane pretreated pulp fibers may be accomplished by any method known in the art including, but not limited to:

- Contact printing methods such as gravure, offset gravure, flexographic printing, and the like.
- A spray applied to a pulp fiber web. For example, spray nozzles may be mounted over a moving pulp fiber web to apply a desired dose of a solution to the moist pulp fiber web. Nebulizers may also be used to apply a light mist to a surface of a pulp fiber web.
- Non-contact printing methods such as ink jet printing, digital printing of any kind, and the like.
- Coating onto one or both surfaces of the pulp fiber web, such as blade coating, air knife coating, short dwell coating, cast coating, size presses, and the like.
- Extrusion of a polysiloxane from a die head such as UFD in the form of a solution, a dispersion or emulsion, or a viscous mixture.
- Foam application of a polysiloxane to the moist or dry pulp fiber web (e.g., foam finishing), either for topical application or for impregnation of the polysiloxane into the pulp fiber web under the influence of a pressure differential (e.g., vacuum-assisted impregnation of the foam). Principles of foam application of additives such as binder agents are described in U.S. Pat. No. 4,297, 860, issued on Nov. 3, 1981 to Pacifici et al. and U.S. Pat. No. 4,773,110, issued on Sep. 27, 1988 to G. J. Hopkins, the disclosures of both of which are incorporated herein by reference to the extent that they are non-contradictory herewith.

Application of a polysiloxane by spray or other means to a moving belt or fabric which in turn contacts the pulp fiber web to apply the polysiloxane to the pulp fiber web, such as is disclosed in WO 01/49937 under the name of S. Eichhorn, published on Jun. 12, 2001.

Tissue Preparation:

At the tissue machine, the dried polysiloxane pretreated pulp fiber is mixed with water to form at least one pulp fiber slurry of the polysiloxane pretreated pulp fiber wherein the polysiloxane may be retained by the individual pulp fibers pretreated with polysiloxane. Non-treated pulp fibers may also be added to the pulp fiber slurry comprising the polysiloxane pretreated pulp fibers. At least one additional pulp fiber slurry is prepared using non-treated pulp fibers in the same manner as the pulp fiber slurry comprising polysiloxane pretreated pulp fibers. In one embodiment of the present invention, a pulp fiber slurry comprising the polysiloxane pretreated pulp fibers and at least one pulp fiber slurry comprising non-treated pulp fibers may be passed to a stratified headbox. The pulp fiber slurries may be deposited from the stratified headbox onto a moving wire or belt, wherein the pulp fiber slurry comprising the polysiloxane pretreated pulp fibers may be directed to at least one of the outside layers of the stratified headbox. The pulp fiber slurries are deposited to form a wet layered tissue sheet 12 wherein the polysiloxane pretreated pulp fibers may comprise at least one of the outer layers of the wet tissue sheet 12 (such as outer layers 14 and/or 16 as shown in FIG. 1 or outer layers 14, 16, 20, and/or 22 as shown in FIG. 2). The wet tissue sheet may be dewatered, dried, and processed to form a dried tissue sheet 12. The dried tissue sheet 12 may be converted into a tissue product 10.

The cellulosic web to be treated can be made by any method known in the art. The web can be wetlaid, such as web formed with known papermaking techniques wherein a dilute aqueous fiber slurry is disposed on a moving wire to filter out the fibers and form an embryonic web which is subsequently dewatered by combinations of units including suction boxes, wet presses, dryer units, and the like. Examples of known dewatering and other operations are given in U.S. Pat. No. 5,656,132 to Farrington et al. Capillary dewatering can also be applied to remove water from the web, as disclosed in U.S. Pat. No. 5,598,643 issued Feb. 4, 1997 and U.S. Pat. No. 4,556,450 issued Dec. 3, 1985, both to S. C. Chuang et al.

For the tissue sheets 12 of the present invention, both creped and uncreped methods of manufacture may be used. Uncreped tissue production is disclosed in U.S. Pat. No. 5,772,845, issued on Jun. 30, 1998 to Farrington, Jr. et al., the disclosure of which is herein incorporated by reference to the extent it is non-contradictory herewith. Creped tissue production is disclosed in U.S. Pat. No. 5,637,194, issued on Jun. 10, 1997 to Ampulski et al.; U.S. Pat. No. 4,529,480, issued on Jul. 16, 1985 to Trokhan; U.S. Pat. No. 6,103,063, issued on Aug. 15, 2000 to Oriaran et al.; and, U.S. Pat. No. 4,440,597, issued on Apr. 3, 1984 to Wells et al., the disclosures of all of which are herein incorporated by reference to the extent that they are non-contradictory herewith. Also suitable for application of the above mentioned polysiloxanes are tissue sheets 12 that are pattern densified or imprinted, such as the webs disclosed in any of the following U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Steltjes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996 to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; and, U.S. Pat. No. 5,628,876, issued on May 13, 1997 to Ayers et al., the disclosures of all of which are herein incorporated by reference to the extent that they are non-contradictory herewith. Such imprinted tissue sheets 12 may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet 12 superposed over the deflection conduits was deflected by an air pressure differential across the deflection conduit to form a lower-density pillow-like region or dome in the tissue sheet 12.

Various drying operations may be useful in the manufacture of the tissue sheets 12 of the present invention. Examples of such drying methods include, but are not limited to, drum drying, through drying, steam drying such as superheated steam drying, displacement dewatering, Yankee drying, infrared drying, microwave drying, radiofrequency drying in general, and impulse drying, as disclosed in U.S. Pat. No. 5,353,521, issued on Oct. 11, 1994 to Orloff and U.S. Pat. No. 5,598,642, issued on Feb. 4, 1997 to Orloff et al., the disclosures of both which are herein incorporated by reference to the extent that they are non-contradictory herewith. Other drying technologies may be used, such as methods employing differential gas pressure include the use of air presses as disclosed U.S. Pat. No. 6,096,169, issued on Aug. 1, 2000 to Hermans et al. and U.S. Pat. No. 6,143,135, issued on Nov. 7, 2000 to Hada et al., the disclosures of both which are herein incorporated by reference to the extent they are non-contradictory herewith. Also relevant are the paper machines disclosed in U.S. Pat. No. 5,230,776, issued on Jul. 27, 1993 to I. A. Andersson et al.

Optional Chemical Additives:

Optional chemical additives may also be added to the aqueous pulp fiber slurries of the present invention and/or to the embryonic tissue sheet 12 to impart additional benefits to the tissue product 10 and process and are not antagonistic to the intended benefits of the present invention. The following chemical additives are examples of additional chemical treatments that may be applied to the tissue sheets 12 comprising the polysiloxane pretreated pulp fibers. The chemical additives are included as examples and are not intended to limit the scope of the present invention. Such chemical additives may be added at any point in the papermaking process, before or after the formation of the tissue sheet 12. The chemical additives may also be added with the polysiloxane during the pretreatment of pulp fibers thereby forming the polysiloxane pretreated pulp fibers, therefore the chemical additives may be added in conjunction with the polysiloxane pretreated pulp fibers. Optionally, the chemical additives may be applied to the pulp fibers during the pulping process that are not pretreated with polysiloxane, thus non-treated pulp fibers.

It is also understood that the optional chemical additives may be employed in specific layers of the tissue sheet 12 or may be employed throughout the tissue sheet 12 as broadly known in the art. For example, in a layered tissue sheet configuration, strength agents may be applied only to the layer of the tissue sheet 12 comprising softwood pulp fibers and/or bulk debonders may be applied only to the layer of the tissue sheet 12 comprising hardwood pulp fibers. While significant migration of the chemical additives into the other untreated layers of the tissue sheet 12 may occur, benefits may be further realized than when the chemical additives are applied to all layers of the tissue sheet 12 on an equal basis. Such layering of the optional chemical additives may be useful in the present invention.

Charge Control Agents:

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight less than 500,000. Drainage and retention aids may also be added to the furnish to improve formation, drainage and fines retention. Included within the retention and drainage aids are microparticle systems containing high surface area, high anionic charge density materials.

Strength Additives:

Wet and dry strength agents may also be applied to the tissue sheet 12. As used herein, the term "wet strength agents" are materials used to immobilize the bonds between pulp fibers in the wet state. Typically, the means by which pulp fibers are held together in tissue sheets and tissue products involve hydrogen bonds and sometimes combinations of hydrogen bonds and covalent and/or ionic bonds. In the present invention, it may be useful to provide a material that will allow bonding of pulp fibers in such a way as to immobilize the fiber-to-fiber bond points and make the pulp fibers resistant to disruption in the wet state. In this instance, the wet state usually will mean when the tissue sheet or tissue product is largely saturated with water or other aqueous solutions, but could also mean significant saturation with body fluids such as urine, blood, mucus, menses, runny bowel movement, lymph and other body exudates.

Any material that when added to a tissue sheet or tissue product results in providing the tissue sheet or tissue product with a mean wet geometric tensile strength:dry geometric tensile strength ratio in excess of 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into tissue sheets or tissue products, will provide a tissue product that retains more than about 50% of its original wet strength after being saturated with water for a period of at least five minutes. Temporary wet strength agents are that provide a tissue product that retains less than about 50% of its original wet strength after being saturated with water for five minutes. Both classes of material may find application in the present invention. The amount of wet strength agent that may be added to the pulp fibers may be about 0.1 dry weight percent or greater, more specifically about 0.2 dry weight percent or greater, and still more specifically from about 0.1 to about 3 dry weight percent, based on the dry weight of the pulp fibers.

Permanent wet strength agents will provide a more or less long-term wet resilience to the structure of a tissue sheet or tissue product. In contrast, the temporary wet strength agents will typically provide tissue sheet or tissue product structures that had low density and high resilience, but would not provide a structure that had long-term resistance to exposure to water or body fluids.

Wet and Temporary Wet Strength Additives:

Temporary wet strength additives may be cationic, nonionic or anionic. Examples of such temporary wet strength additives include PAREZ™ 631 NC and PAREZ® 725 temporary wet strength resins that are cationic glyoxylated polyacrylamides available from Cytec Industries, located at West Paterson, N.J. These and similar resins are described in U.S. Pat. No. 3,556,932, issued to Coscia et al. and U.S. Pat. No. 3,556,933, issued to Williams et al. Hercobond 1366, manufactured by Hercules, Inc. located at Wilmington, Del. is another commercially available cationic glyoxylated polyacrylamide that may be used with the present invention. Additional examples of temporary wet strength additives include dialdehyde starches such as Cobond 1000® commercially available from National Starch and Chemical Company and other aldehyde containing polymers such as those described in U.S. Pat. No. 6,224,714, issued on May 1, 2001 to Schroeder et al.; U.S. Pat. No. 6,274,667, issued on Aug. 14, 2001 to Shannon et al.; U.S. Pat. No. 6,287,418, issued on Sep. 11, 2001 to Schroeder et al.; and, U.S. Pat. No. 6,365,667, issued on Apr. 2, 2002 to Shannon et al., the disclosures of all of which are herein incorporated by reference to the extent that they are non-contradictory herewith.

Permanent wet strength agents comprising cationic oligomeric or polymeric resins may be used in the present invention. Polyamide-polyamine-epichlorohydrin type resins such as KYMENE 557H sold by Hercules, Inc. located at Wilmington, Del. are the most widely used permanent wet-strength agents and are suitable for use in the present invention. Such materials have been described in the following U.S. Pat. No. 3,700,623, issued on Oct. 24, 1972 to Keim; U.S. Pat. No. 3,772,076, issued on Nov. 13, 1973 to Keim; U.S. Pat. No. 3,855,158, issued on Dec. 17, 1974 to Petrovich et al.; U.S. Pat. No. 3,899,388, issued on Aug. 12, 1975 to Petrovich et al.; U.S. Pat. No. 4,129,528, issued on Dec. 12, 1978 to Petrovich et al.; U.S. Pat. No. 4,147,586, issued on Apr. 3, 1979 to Petrovich et al.; and, U.S. Pat. No. 4,222,921, issued on Sep. 16, 1980 to van Eenam. Other cationic resins include polyethylenimine resins and aminoplast resins obtained by reaction of formaldehyde with melamine or urea. Permanent and temporary wet strength resins may be used together in the manufacture of tissue sheets and tissue products with such use being recognized as falling within the scope of the present invention.

Dry Strength Additives:

Dry strength resins may also be applied to the tissue sheet without affecting the performance of the disclosed polysiloxanes of the present invention. Such materials may include, but are not limited to, modified starches and other polysaccharides such as cationic, amphoteric, and anionic starches and guar and locust bean gums, modified polyacrylamides, carboxymethylcellulose, sugars, polyvinyl alcohol, chitosan, and the like. Such dry strength additives are typically added to the pulp fiber slurry prior to the formation of the tissue sheet or as part of the creping package.

Additional Softness Additives:

It may be desirable to add additional debonders or softening chemistries to a tissue sheet. Such softness additives may be found to further enhance the hydrophilicity of the finished tissue product. Examples of debonders and softening chemistries may include the simple quaternary ammonium salts having the general formula $(R^{1'})_{4-b}$—$N^+$—$(R^{1''})_bX^-$ wherein $R^{1'}$ is a $C_{1-6}$ alkyl group, $R^{1''}$ is a $C_{14}$–$C_{22}$ alkyl group, b is an integer from 1 to 3 and $X^-$ is any suitable counterion. Other similar compounds may include the monoester, diester, monoamide, and diamide derivatives of the simple quaternary ammonium salts. A number of variations on these quaternary ammonium compounds should be considered to fall within the scope of the present invention. Additional softening compositions include cationic oleyl imidazoline materials such as methyl-1-oleyl amidoethyl-2-oleyl imidazo linium methylsulfate commercially available as Mackernium CD-183 from McIntyre Ltd., located in University Park, Ill. and Prosoft TQ-1003 available from Hercules, Inc. Such softeners may also incorporate a humectant or a plasticizer such as a low molecular weight polyethylene glycol (molecular weight of about 4,000 daltons or less) or a polyhydroxy compound such as glycerin or propylene glycol. These softeners may be applied to the pulp fibers while in a pulp fiber slurry prior to the formation of a tissue sheet to aid in bulk softness. Additional bulk softening agents suitable for addition to the slurry of pulp fibers include cationic polysiloxanes such as those described in U.S. Pat. No. 5,591,306, issued on Jan. 7, 1997 to Kaun and U.S. Pat. No. 5,725,736, issued on Mar. 10, 1998 to Schroeder, the disclosures of both which are herein incorporated by reference to the extend that they are non-contradictory herewith. At times, it may be desirable to add such secondary softening agents simultaneously with the polysiloxanes of the present invention. In such cases, solutions or emulsions of the softening composition and polysiloxane may be blended.

Miscellaneous Agents:

Additional types of chemical additives that may be added to the tissue sheet include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin e and the like may also be incorporated into the tissue sheet.

In general, the polysiloxane pretreated pulp fibers of the present invention may be used in conjunction with any known materials and chemical additives that are not antagonistic to their intended use. Examples of such materials include, but are not limited to, odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, humectants, emollients, and the like. A wide variety of other materials and chemical additives known in the art of tissue-making production may be included in the tissue sheets of the present invention.

The application point for these materials and chemical additives is not particularly relevant to the invention and such materials and chemical additives may be applied at any point in the tissue manufacturing process. This includes pretreatment of pulp, application in the wet end of the process, post-treatment after drying but on the tissue machine and topical post-treatment.

Analytical Methods

Determination of Atomic % Silicon

X-ray photoelectron spectroscopy (XPS) is a method used to analyze certain elements lying on the surface of a material. Sampling depth is inherent to XPS. Although the x-rays can penetrate the sample microns, only those electrons that originate at the outer ten Angstroms below the solid surface can leave the sample without energy loss. It is these electrons that produce the peaks in XPS. The electrons that interact with the surrounding atoms as they escape the surface form the background signal. The sampling depth is defined as 3 times the inelastic mean free path (the depth at which 95% of the photoemission takes place), and is estimated to be 50–100 angstroms. The mean free path is a function of the energy of the electrons and the material that they travel through.

The flux of photoelectrons that come off the sample, collected, and detected is elemental and instrumental dependant. It is not overly critical to the results as herein expressed. The atomic sensitivity factors are various constants for each element that account for these variables. The atomic sensitivity factors are supplied with the software from each XPS instrument manufacturer. Those skilled in the art will understand the need to use the set of atomic sensitivity factors designed for their instrument. The atomic sensitivity factor (S) is defined by the equation:

$S = f\sigma\theta y\lambda AT$ and is a constant for each photoelectron.

f=x-ray flux

σ=photoelectron cross-section

θ–angular efficiency factor y=efficiency in the photoelectron process

λ=mean free path

A=area of sample

T=detection efficiency

Atomic concentrations are determined by the following equation:

$$C_x = I_x/S_x/(\Sigma I_i/S_i)$$

Cx=atomic fraction of element x

Ix=peak intensity of photoelectron of element x

Sx=atomic sensitivity factor for photoelectron of element x

XPS was used to determine the z-directional polysiloxane gradient. An approximately 1 cm×1 cm sample was cut from a tissue sheet comprising polysiloxane pretreated pulp fibers and cut in ½ to provide two 1 cm×0.5 cm specimens of the tissue sheet. Analysis of the surfaces of the specimens of the tissue sheet was conducted on a representative portion of each specimen, approximately 1 cm×0.5 cm. The specimens were mounted on a sample holder using double sided tape such as Scotch Brand Double Stick Tape, 3M Corp., Minneapolis, Minn. An equivalent tape may be used provided that the equivalent tape does not contain silicones and does not off-gas to an appreciable extent. Tape size is not overly critical, but should be slightly larger than the sample size to prevent having to pump on extraneous material. One of the two specimens cut from the 1 cm×1 cm square is used to measure the top outer surface of the tissue sheet and the other specimen is used to measure the bottom outer surface of the tissue sheet. Three sample points are tested for each of the specimens representing the top and bottom outer surfaces and the average of the three sample points is reported.

The samples were analyzed utilizing a Fisons M-Probe XPS spectrometer equipped with monochromatic Al Ka x-rays, using the an analysis region of about 1 $mm^2$. Charge neutralization was accomplished using the electron flood gun/screen (FGS) method. Atomic sensitivity factors, supplied with the Fisons M-Probe spectrometer, were used to establish the relative atomic concentration of the elements detected by the spectrometer. The atomic Si concentration is used to define the level of polysiloxane on the outer surfaces of the tissue sheet.

Total Polysiloxane in Sheet

The polydimethyl siloxane content on the pulp fiber substrates was determined using the following procedure. A sample containing dimethyl siloxane is placed in a headspace vial, boron trifluoride reagent is added, and the vial sealed. After reacting for about fifteen minutes at about 100° C., the resulting Diflourodimethyl siloxane in the headspace of the vial is measured by gas chromatography using an FID detector.

$$3\ Me_2SiO + 2\ BF_3.O(C_2H_5)_2 \rightarrow 3\ Me_2SiF_2 + B_2O_3 + 2\ (C_2H_5)_2O$$

The method described herein was developed using a Hewlett-Packard Model 5890 Gas Chromatograph with an FID and a Hewlett-Packard 7964 autosampler. An equivalent gas chromatography system may be substituted.

The instrument was controlled by, and the data collected using, Perkin-Elmer Nelson Turbochrom software (version 4.1). An equivalent software program may be substituted. A J&W Scientific GSQ (30 m×0.53 mm i.d.) column with film thickness 0.25 μm, Cat. # 115-3432 was used. An equivalent column may be substituted.

The gas chromatograph was equipped with a Hewlett-Packard headspace autosampler, HP-7964 and set up at the following conditions:

| | | | |
|---|---|---|---|
| Bath Temperature: | 100° C. | Loop Temperature: | 110° C. |
| Transfer Line Temperature: | 120° C. | GC Cycle Time: | 25 minutes |
| Vial Equilibrium Time: | 15 minutes | Pressurize Time: | 0.2 minutes |
| Loop Fill Time: | 0.2 minutes | Loop Equil. Time: | 0.05 minutes |
| Inject Time: | 1.0 minute | Vial Shake: | 1 (Low) |

The Gas Chromatograph was set to the following instrument conditions:

Carrier gas: Helium

Flow rate: 16.0 mL through column and 14 mL make-up at the detector.

Injector Temperature: 150° C.

Detector Temperature: 220° C.

Chromatography Conditions:

50° C. for 4 minutes with a ramp of 10° C./minute to 150° C.

Hold at final temperature for 5 minutes.

Retention Time: 7.0 min. for DFDMS

A stock solution containing approximately 5000 μg/ml polydimethyl siloxane was prepared in the following manner. Approximately 1.25 grams of the polydimethyl siloxane emulsion is weighed to the nearest 0.1 mg into a 250-ml volumetric flask. The actual weight (represented as X) is recorded. Distilled water is added and the flask swirled to dissolve/disperse the emulsion. When dissolved/dispersed, the emulsion is diluted to volume with water and mixed. The ppm of the polysiloxane emulsion (represented as Y) is calculated from the following equation:

$$\text{PPM polysiloxane emulsion } Y = X/0.250$$

The Calibration Standards are made to bracket the target concentration by adding 0 (blank), 50, 100, 250, and 500 μL of the Stock Solution (the volume in uL $V_c$ recorded) to successive 20 mL headspace vials containing 0.1±0.001 grams of an untreated control tissue sheet. The solvent is evaporated by placing the headspace vials in an oven at a temperature ranging between about 60 to about 70° C. for 15 minutes. The μg of emulsion (represented as Z) for each calibration standard is calculated from the following equation:

$$Z = Vc * Y/1000$$

The calibration standards are then analyzed according to the following procedure: 0.100±0.001 g sample of a tissue sheet is weighed to the nearest 0.1 mg into a 20-ml headspace vial. The sample weight (represented as $W_s$) in mg is recorded. The amount of tissue sheet taken for the standards and samples must be the same.

100 μL of $BF_3$ reagent is added to each of the tissue sheet samples and calibration standards. Each vial is sealed immediately after adding the $BF_3$ reagent.

The sealed vials are placed in the headspace autosampler and analyzed using the conditions described previously, injecting 1 mL of the headspace gas from each tissue sheet sample and calibration standard.

A calibration curve of μg emulsion versus analyte peak area is prepared.

The analyte peak area of the tissue sheet sample is then compared to the calibration curve and amount of polydimethylsiloxane emulsion (represented as (A)) in μg on the tissue sheet determined.

The amount of polydimethylsiloxane emulsion (represented as (C)) in percent by weight on the tissue sample is computed using the following equation:

$$(C) = (A)/(W_s * 10^4)$$

The amount of the polydimethyl siloxane (represented as (D)) in percent by weight on the tissue sheet sample is computed using the following equation and the weight % polysiloxane (represented as (F)) in the emulsion:

$$(D) = (C) * (F)/100$$

Basis Weight Determination (Tissue)

The basis weight and bone dry basis weight of the tissue sheet specimens was determined using a modified TAPPI T410 procedure. As is basis weight samples were conditioned at 23° C.±1° C. and 50±2% relative humidity for a minimum of 4 hours. After conditioning a stack of 16—3"×3" samples was cut using a die press and associated die. This represents a tissue sheet sample area of 144 $in^2$. Examples of suitable die presses are TMI DGD die press manufactured by Testing Machines, Inc. located at Islandia, N.Y., or a Swing Beam testing machine manufactured by USM Corporation, located at Wilmington, Mass. Die size tolerances are +/−0.008 inches in both directions. The specimen stack is then weighed to the nearest 0.001 gram on a tared analytical balance. The basis weight in pounds per 2880 $ft^2$ is then calculated using the following equation:

$$\text{Basis weight} = \text{stack wt. In grams}/454 * 2880$$

The bone dry basis weight is obtained by weighing a sample can and sample can lid to the nearest 0.001 grams (this weight is A). The sample stack is placed into the sample can and left uncovered. The uncovered sample can and stack along with sample can lid is placed in a 105° C.±2° C. oven for a period of 1 hour±5 minutes for sample stacks weighing less than 10 grams and at least 8 hours for sample stacks weighing 10 grams or greater. After the specified oven time has lapsed, the sample can lid is placed on the sample can and the sample can removed from the oven. The sample can is allowed to cool to approximately ambient temperature but no more than 10 minutes. The sample can, sample can lid, and sample stack are then weighed to the nearest 0.001 gram (this weight is C). The bone dry basis weight in pounds/2880 $ft^2$ is calculated using the following equation:

$$\text{Bone Dry } BW=(C-A)/454*2880$$

Dry Tensile (Tissue)

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0° C.±1.0° C., 50.0±2.0% relative humidity, and after the tissue sheet has equilibrated to the testing conditions for a period of not less than four hours. Testing is conducted on a tensile testing machine maintaining a constant rate of elongation, and the width of each specimen tested was 3 inches. The "jaw span" or the distance between the jaws, sometimes referred to as gauge length, is 2.0 inches (50.8 mm). The crosshead speed is 10 inches per minute (254 mm/min.) A load cell or full-scale load is chosen so that all peak load results fall between 10 and 90 percent of the full-scale load. In particular, the results described herein were produced on an Instron 1122 tensile frame connected to a Sintech data acquisition and control system utilizing IMAP software running on a "486 Class" personal computer. This data system records at least 20 load and elongation points per second. A total of 10 specimens per sample are tested with the sample mean being used as the reported tensile value. The geometric mean tensile is calculated from the following equation:

$$GMT=(MD\ \text{Tensile}*CD\ \text{Tensile})^{1/2}$$

To account for small variations in basis weight, GMT values were then corrected to the 18.5 pounds/2880 $ft^2$ target basis weight using the following equation:

$$\text{Corrected } GMT=\text{Measured } GMT*(18.5/\text{Bone Dry Basis Weight})$$

Wet Out Time

The Wet Out Time of a tissue sheet treated in accordance with the present invention is determined by cutting 20 sheets of the tissue sheet sample into 2.5 inch squares. The number of sheets of the tissue sheet sample used in the test is independent of the number of plies per sheet of the tissue sheet sample. The 20 square sheets of the tissue sheet sample are stacked together and stapled at each corner to form a pad of the tissue sheet sample. The pad of the tissue sheet sample is held close to the surface of a constant temperature distilled water bath (23° C.±2° C.), which is the appropriate size and depth to ensure the saturated pad of the tissue sheet sample does not contact the bottom of the water bath container and the top surface of the distilled water of the water bath at the same time, and dropped flat onto the surface of the distilled water, with staple points on the pad of the tissue sheet sample facing down. The time necessary for the pad of the tissue sheet sample to become completely saturated, measured in seconds, is the Wet Out Time for the tissue sheet sample and represents the absorbent rate of the tissue sheet sample. Increases in the Wet Out Time represent a decrease in absorbent rate of the tissue sheet sample. The test is stopped at 300 seconds with any sheet not wetting out in that period given a value of about 300 seconds or greater.

Hercules Size Test

Hercules size testing was done in general accordance with TAPPI method T 530 PM-89, Size Test for Paper with Ink Resistance. Hercules Size Test data was collected on a Model HST tester using white and green calibration tiles and the black disk provided by the manufacturer. A 2% Napthol Green N dye diluted with distilled water to 1% was used as the dye. All materials are available from Hercules, Inc., located at Wilmington, Del.

All specimens were conditioned for at least 4 hours at 23° C.±1° C. and 50±2% relative humidity prior to testing. The test is sensitive to dye solution temperature so the dye solution should also be equilibrated to the controlled condition temperature for a minimum of 4 hours before testing.

6 tissue sheets (12 plies for a 2-ply product, 18 plies for a 3-ply product, etc.) are selected for testing. The tissue sheet specimens are cut to an approximate dimension of 2.5×2.5 inches. The instrument is standardized with white and green calibration tiles per manufacturer's directions. The tissue sheet specimen (12 plies for a 2-ply product) is placed in the sample holder with the outer surface of the tissue sheets facing outward. The tissue sheet specimen is then clamped into the specimen holder. The specimen holder is then positioned in the retaining ring on top of the optical housing. Using the black disk the instrument zero is calibrated. The black disk is removed and 10±0.5 milliliters of dye solution is dispensed into the retaining ring and the timer started while placing the black disk back over the specimen. The test time in seconds is recorded from the instrument.

Caliper

The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up. Caliper is expressed in microns. Caliper was measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked tissue sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 g kilo Pascals).

Sensory Softness

Sensory softness is an assessment of tissue sheet in-hand feel softness. This panel is lightly trained so as to provide assessments closer to those a consumer might provide. The strength lies in its generalizability to the consumer population. This softness measure is employed when the purpose is to obtain a holistic overview of attributes of the tissue sheets and to determine if differences in the tissue sheets are humanly perceivable.

The following is the specific softness procedure the panelists utilize while evaluating sensory softness for bath, facial and towel products. Samples of tissue sheets or tissue products are placed across the non-dominant arm with the coded side facing up. The pads of the thumb, index, and middle fingers of the dominant hand are then moved in a circular motion lightly across several areas of the sample. The velvety, silky, and fuzzy feel of the samples of the tissue sheets or tissue products is evaluated. Both sides of the samples are evaluated in the same manner. The procedure is then repeated for each additional sample. The samples are then ranked by the analyst from least to most soft.

The sensory softness data results are analyzed using a Freidman Two-Way Analysis of Variance (ANOVA) by Ranks. This analysis is a non-parametric test used for ranking data. The purpose is to determine if there is a difference between different experimental treatments. If there is not a ranking difference between the different experimental treatments, it is reasoned that the median response for one treatment is not statistically different than the median response of the other treatment, or any difference is caused by chance.

Sensory softness is assessed by between 10 to 12 panelists applying a rank order paradigm with no replications. For each individual attribute, approximately 24–72 data points are generated. A maximum of six codes may be ranked at one time. More codes may be assessed in multiple studies; however, a control code should be present in each study to provide a common reference if codes are to be compared across multiple studies.

Sensory softness is employed when it is desirable to obtain a holistic assessment of softness or to determine if sample differences are humanly perceivable. This panel is gently trained to provide assessments closer to those a consumer might provide. Sensory softness is useful for obtaining a read as to whether a sample change is humanly detectable and/or affects the softness perception. A control code also is used to provide a link across multiple studies.

EXAMPLES

For all examples, the polysiloxane pretreated pulp fiber was made in general accordance with the following procedure. Fully bleached eucalyptus kraft pulp fibers were prepared into a pulp fiber slurry having a pH value of about 4.5. The pulp fiber slurry was formed into a pulp fiber mat having a basis weight of about 900 g/m$^2$, pressed and dried to about 85% solids. A neat polydimethyl siloxane, Q2-8220 available from Dow Corning located in Midland, Minn., was applied via a modified size press to both sides of the pulp fiber mat. The amount of polysiloxane applied to the pulp fiber mat was about 1.5% by weight of total bone dry pulp fiber. The pulp fiber mat was then dried further to about 95% solids or greater before being processed into rolls or bales. The amount of polysiloxane on the pulp fibers was determined by the analytical gas chromatography method previously described.

Examples 1–3 illustrate preparation of a two layer two ply tissue sheet using silicone pretreated pulp in a manner that increases the hydrophobicity of the tissue.

Example 1

The tissue sheet was manufactured according to the following procedure. About 60 pounds of polysiloxane pretreated eucalyptus hardwood kraft pulp fibers, comprising about 1.5% polysiloxane, were dispersed in a pulper for 30 minutes, forming an eucalyptus hardwood kraft pulp fiber slurry having a consistency of about 3%. The Eucalyptus hardwood pulp fiber slurry was then transferred to a machine chest and diluted to a consistency of about 0.75%.

About 60 pounds, air dry basis weight, of LL-19 northern softwood kraft pulp fibers were dispersed in a pulper for 30 minutes, forming a northern softwood kraft pulp fiber slurry having a consistency of about 3%. A low level of refining was applied for 6 minutes to the northern softwood kraft pulp fibers. After dispersing, the northern softwood kraft pulp fibers to form the slurry, the northern softwood kraft pulp fibers were passed to a machine chest and diluted to a consistency of about 0.75%. 1.8 pounds per ton of a commercially available glyoxylated PAM, Parez 631NC, was added to the northern softwood kraft pulp fibers in the machine chest and allowed to mix for 5 minutes prior to forwarding to the headbox.

Kymene 6500, a commercially available PAE wet strength resin from Hercules, Inc., was added to both the eucalyptus hardwood kraft pulp fiber and the northern softwood kraft pulp fiber slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 65% Eucalyptus hardwood kraft pulp fibers in the dryer side layer and about 35% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15% to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared comprising about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of approximately 0.25 g solids/m$^2$ of product. The finished layered tissue sheet was then converted into a 2-ply c-folded tissue product with the dryer side layer of each ply facing outward. The tissue product was analyzed for wet out times. The total % polysiloxane in the sample of the tissue product is about 1.0% by weight of total pulp fiber. The tissue product had a wet out time of greater than about 300 seconds and a Hercules Size Test (HST) value of greater than about 300 seconds, indicating a high level of hydrophobicity in the tissue sheet and the tissue product.

Example 2

The tissue sheet was manufactured according to the following procedure. About 30 pounds of polysiloxane pretreated eucalyptus hardwood kraft pulp fibers, comprising about 1.5% polysiloxane, and about 30 pounds of non-treated eucalyptus hardwood kraft pulp fibers (pulp fibers not pretreated with polysiloxane) were dispersed in a pulper for about 30 minutes, forming an eucalyptus hardwood kraft pulp fiber slurry comprising eucalyptus hardwood kraft polysiloxane pretreated pulp fibers and eucalyptus hardwood kraft non-treated pulp fibers having a consistency of about 3%. The Eucalyptus hardwood kraft pulp fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber and the northern softwood kraft pulp slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 65% Eucalyptus hardwood kraft pulp fibers in the dryer side layer and about 35% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample of the tissue product is about 0.5% by weight of total pulp fiber. The tissue product had a wet out time of greater than about 300 seconds and a Hercules Size Test (HST) value of greater than about 300 seconds, indicating a high level of hydrophobicity in the tissue sheet and the tissue product.

Example 3

The tissue sheet was manufactured according to the following procedure. About 15 pounds of polysiloxane pretreated eucalyptus hardwood kraft pulp fibers, comprising about 1.5% polysiloxane, and about 45 pounds of non-treated eucalyptus hardwood kraft pulp fibers (pulp fibers not pretreated with polysiloxane) were dispersed in a pulper for about 30 minutes, forming an eucalyptus hardwood pulp kraft fiber slurry comprising eucalyptus hardwood kraft polysiloxane pretreated pulp fibers and eucalyptus hardwood kraft non-treated pulp fibers having a consistency of about 3%. The Eucalyptus hardwood fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber and northern softwood kraft pulp fiber slurries in the machine chest at a rate of about 4 pounds of dry chemical per ton of dry fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 65% Eucalyptus hardwood kraft pulp fibers in the dryer side layer and about 35% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward and analyzed for wet out times. The total % polysiloxane in the sample of the tissue product is about 0.25% by weight of total pulp fiber. The tissue product had a wet out time of greater than 300 seconds and a Hercules Size Test (HST) value of about 94.8 seconds or greater, indicating a high level of hydrophobicity in the tissue sheet and the tissue product.

Example 4

The tissue sheet was manufactured according to the following procedure. About 6 pounds of polysiloxane pretreated eucalyptus hardwood kraft pulp fibers, comprising about 1.5% polysiloxane, and about 54 pounds of eucalyptus hardwood kraft pulp fibers (pulp fibers not pretreated with polysiloxane) were dispersed in a pulper for about 30 minutes, forming an eucalyptus hardwood pulp kraft fiber slurry having a consistency of about 3%. The Eucalyptus hardwood fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry were passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber and northern softwood kraft pulp fiber slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 65% Eucalyptus hardwood kraft pulp fibers in the dryer side layer and about 35% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample of the tissue product is about 0.15% by weight of total pulp fiber. The tissue product had a wet out time of about 158 seconds and a Hercules Size Test (HST) value of about 20.9 seconds, indicating a relatively high level of hydrophobicity at a very low total polysiloxane content in the tissue sheet and tissue product.

Example 5

The tissue sheet was manufactured according to the following procedure. About 54 pounds of polysiloxane pretreated eucalyptus hardwood kraft pulp fibers, containing about 1.5% polysiloxane, and about 6 pounds of non-treated LL-19 northern softwood kraft pulp fibers (pulp fibers not pretreated with polysiloxane) were dispersed in a pulper for about 30 minutes, forming an eucalyptus hardwood kraft pulp fiber/northern softwood kraft pulp fiber slurry having a consistency of about 3%. The Eucalyptus hardwood kraft pulp fiber/northern kraft pulp fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber/northern kraft pulp fiber and northern softwood kraft pulp slurries in the machine chest at a rate of about 4 pounds of dry chemical per ton of dry fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 35% Eucalyptus hardwood kraft pulp fibers in the dryer side layer and about 65% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample of the tissue product is about 0.5% by weight of total pulp fiber. The tissue product had a wet out time of about 225 seconds and a Hercules Size Test (HST) value of about 29.8 seconds, indicating a significantly lower level of hydrophobicity in the tissue sheet and the tissue product compared to Example 2 containing the same level of polysiloxane.

Example 6

The tissue sheet was manufactured according to the following procedure. About 30 pounds of polysiloxane pretreated eucalyptus hardwood pulp fibers, containing about 1.5% polysiloxane, about 24 pounds of non-treated eucalyptus hardwood kraft pulp fibers (pulp fibers not pretreated with polysiloxane) and about 6 pounds of non-treated LL-19 northern softwood kraft pulp fibers (pulp fibers not pretreated with polysiloxane) were dispersed in a pulper for about 30 minutes, forming an eucalyptus hardwood pulp kraft fiber/northern kraft pulp fiber slurry having a consistency of about 3%. The Eucalyptus hardwood kraft pulp fiber/northern kraft pulp fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber/northern softwood kraft pulp and northern softwood kraft pulp slurries in the machine chest at a rate of about 4 pounds of dry chemical per ton of dry fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target web basis weight of about 12.7 gsm and a layer split of about 35% Eucalyptus hardwood kraft pulp fibers on the dryer side layer and about 65% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex., (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample of the tissue product is about 0.25% by weight of total pulp fiber. The tissue product had a wet out time of about 31.5 seconds and a Hercules Size Test (HST) value of about 6.9 seconds, indicating a low level of hydrophobicity in the tissue sheet and the tissue product. These results were compared to those from Example 3 having a wet out time greater than 300 seconds and an HST value of about 94.8 seconds, showing the results by positioning the polysiloxane pretreated pulp fibers in a narrow layer at the outer surface of the tissue sheet.

Example 7

The tissue sheet was manufactured according to the following procedure. About 15 pounds of polysiloxane pretreated eucalyptus hardwood kraft pulp fibers, comprising about 1.5% polysiloxane, about 39 pounds of non-treated eucalyptus hardwood kraft pulp fibers (pulp fibers not pretreated with polysiloxane) and about 6 pounds of non-treated LL-19 northern softwood kraft pulp fibers (pulp fibers not pretreated with polysiloxane) were dispersed in a pulper for about 30 minutes, forming an eucalyptus hardwood pulp kraft pulp fiber/northern softwood kraft pulp fiber slurry having a consistency of about 3%. The Eucalyptus hardwood kraft pulp fiber/northern softwood kraft pulp fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber/northern softwood kraft pulp fiber and northern softwood kraft pulp slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target tissue sheet basis weight of about 12.7 gsm and a layer split of about 35% Eucalyptus hardwood kraft pulp fibers in the dryer side layer and about 65% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex., (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample of the tissue product is about 0.12% by weight of total pulp fiber. The tissue product had a wet out time of about 17.4 seconds and a Hercules Size Test (HST) value of about 4.7 seconds, indicating a low level of hydrophobicity in the tissue sheet and the tissue product. These results were compared to those from Example 4 having a wet out time greater than 300 seconds and an HST value of about 20.8 seconds, showing the results of positioning the polysiloxane pretreated pulp fibers in a narrow layer at the outer surface of the tissue sheet.

Example 8

The tissue sheet was manufactured according to the following procedure. About 6 pounds of polysiloxane pretreated eucalyptus hardwood kraft pulp fibers, comprising about 1.5% polysiloxane, about 48 pounds of non-treated eucalyptus hardwood kraft pulp fibers (pulp fibers not pretreated with polysiloxane) and about 6 pounds of non-treated LL-19 northern softwood kraft pulp fibers (pulp fibers not pretreated with polysiloxane) were dispersed in a pulper for about 30 minutes, forming an eucalyptus hardwood pulp kraft pulp fiber/northern softwood kraft pulp fiber slurry having a consistency of about 3%. The Eucalyptus hardwood kraft pulp fiber slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber/northern softwood kraft pulp fiber and northern softwood kraft pulp fiber slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue. The flow rates of the stock pulp fiber slurries into the flow spreader were adjusted to give a target tissue sheet basis weight of about 12.7 gsm and a layer split of about 35% Eucalyptus hardwood kraft pulp fibers in the dryer side layer and about 65% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex. (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample is about 0.053% by weight of total pulp fiber. The tissue product had a wet out time of about 7.6 seconds and a Hercules Size Test (HST) value of about 2.5 seconds, indicating a very low level of hydrophobicity in the tissue sheet and the tissue product.

Example 9

Example 9 demonstrates preparation of a control comprising non-treated pulp fiber.

The tissue sheet was manufactured according to the following procedure. About 54 pounds of non-treated eucalyptus hardwood kraft pulp fibers (pulp fibers not pretreated with polysiloxane) and about 6 pounds of non-treated LL-19 northern softwood kraft pulp fibers (pulp fibers not pretreated with polysiloxane) were dispersed in a pulper for about 30 minutes, forming an eucalyptus hardwood kraft pulp fiber slurry having a consistency of about 3%. The eucalyptus hardwood kraft pulp fiber/northern softwood kraft pulp slurry was then transferred to a machine chest and diluted to a consistency of about 0.75%.

About 60 pounds, air dry basis weight, of LL-19 northern softwood kraft pulp fibers were dispersed in a pulper for about 30 minutes, forming a northern softwood kraft pulp fiber slurry having a consistency of about 3%. A low level of refining was applied for about 6 minutes to the northern softwood kraft pulp fibers. After dispersing, the northern softwood kraft pulp fibers to form the slurry, the northern softwood kraft pulp fiber slurry was passed to a machine chest and diluted to a consistency of about 0.75%. About 1.8 pounds per ton of a commercially available glyoxylated PAM, Parez 631NC, was added to the northern softwood kraft pulp fibers in the machine chest and allowed to mix for about 5 minutes prior to forwarding to the headbox.

Kymene 6500, a commercially available PAE wet strength resin from Hercules, Inc., was added to both the eucalyptus hardwood kraft pulp fiber/northern softwood kraft pulp fiber and northern softwood kraft pulp fiber slurries in the machine chest at a rate of about 4 pounds of dry chemical per ton of dry pulp fiber.

The stock pulp fiber slurries were further diluted to about 0.1 percent consistency prior to forming and deposited from a two layered headbox onto a fine forming fabric having a velocity of about 50 feet per minute to form a 17" wide tissue sheet. The flow rates of the stock pulp fiber slurries into the flow spreader were adjusted to give a target web basis weight of about 12.7 gsm and a layer split of abut 35% Eucalyptus hardwood kraft pulp fibers in the dryer side layer and about 65% LL-19 northern softwood kraft pulp fibers in the felt side layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue sheet.

An aqueous creping composition was prepared containing about 0.635% by weight of polyvinyl alcohol (PVOH), available under the trade designation of Celvol 523 manufactured by Celanese, located at Dallas, Tex., (88% hydrolyzed with a viscosity of about 23 to about 27 cps. for a 6% solution at 20° C.) and about 0.05% by weight of a PAE resin, available under the trade designation of Kymene 6500 from Hercules, Inc. All weight percentages are based on dry pounds of the chemical being discussed. The creping composition was prepared by adding the specific amount of each chemical to 50 gallons of water and mixing well. PVOH was obtained as a 6% aqueous solution and Kymene 557 as a 12.5% aqueous solution. The creping composition was then applied to the Yankee dryer surface via a spray boom at a pressure of about 60 psi at a rate of about 0.25 g solids/$m^2$ of product. The finished layered tissue sheet was then converted into a 2-ply c-folded tissue product with the dryer side layer of each tissue sheet facing outward. The tissue product was analyzed for wet out times. The total % polysiloxane in the sample of the tissue product is about 0.0% by weight of total pulp fiber. The tissue product had a wet out time of about 3.9 seconds and a Hercules Size Test (HST) value of about 1.6 seconds, indicating a very low level of hydrophobicity in the tissue sheet and the tissue product.

Examples 10 to 12 illustrate the use of a cationic debonder/surfactant in the wet end of the tissue machine to further enhance the hydrophilicity of the tissue sheet and ultimately, the tissue product.

Example 10

A two-ply creped facial tissue product was made in accordance with Example 1 except that about 31 grams of an 80% solution of a cationic oleylimidazoline debonder, Prosoft TQ-1003, commercially available from Hercules, Inc., was added to the 60 pounds of polysiloxane pretreated eucalyptus hardwood kraft pulp fibers in the machine chest.

Total concentration of debonder in the layer was about 2 pounds/metric ton of dry pulp fiber and about 1.3 pounds per metric ton of dry pulp fiber in the tissue product. The wet out time and HST values of the tissue product remained above 300 seconds each.

Example 11

A two ply creped facial tissue product was made in accordance with Example 2 except that about 31 grams of an 80% solution of a cationic oleylimidazoline debonder, Prosoft TQ-1003, commercially available from Hercules, Inc., was added to the 60 pounds of pulp fiber (about 30 pounds of polysiloxane pretreated eucalyptus hardwood kraft pulp fibers, comprising about 1.5% polysiloxane, and about 30 pounds of non-treated eucalyptus hardwood kraft pulp fibers (pulp fibers not pretreated with polysiloxane)) in the machine chest. Total concentration of debonder in the layer was about 2 pounds/metric ton of dry pulp fiber and about 1.3 pounds per metric ton of dry pulp fiber in the tissue product. The wet out time of the tissue product was greater than 300 seconds and HST value was found to be about 78.9 seconds.

Example 12

A two ply creped facial tissue product was made in accordance with Example 5 except that about 77.5 grams of an 80% solution of a cationic oleylimidazoline debonder, Prosoft TQ-1003, commercially available from Hercules, Inc., was added to the 60 pounds of pulp fiber (about 54 pounds of polysiloxane pretreated eucalyptus hardwood kraft pulp fibers, containing about 1.5% polysiloxane, and about 6 pounds of non-treated LL-19 northern softwood kraft pulp fibers (pulp fibers not pretreated with polysiloxane)) in the machine chest. Total concentration of debonder in the layer was about 5 pounds/metric ton of dry pulp fiber and about 1.75 pounds per metric ton of dry pulp fiber in the tissue product. The wet out time of the tissue product was about 147 seconds and HST value of the tissue product was found to be about 18.4 seconds.

Sensory softness was evaluated on all codes in the examples. In all cases, the codes comprising the polysiloxane pretreated pulp fibers were rated as being significantly softer than the corresponding control codes not containing the polysiloxane pretreated pulp fibers.

Table 1 summarizes the results showing the differences when positioning the polysiloxane pretreated pulp fibers in a thin layer versus positioning the polysiloxane pretreated pulp fibers in a thicker layer. Table 1 also includes data showing the hydrophobicity of the tissue sheets.

TABLE 1

| Example | PDMS layer % thickness of total cheet | % PDMS in total sheet | % PDMS in dryer layer. | HST time in sec. | Wet out time in sec. |
|---|---|---|---|---|---|
| 1 | 65 | 1.0 | 1.5 | >300 | >300 |
| 2 | 65 | 0.5 | 0.75 | >300 | >300 |
| 3 | 65 | 0.25 | 0.37 | 94.8 | >300 |
| 4 | 65 | 0.10 | 0.15 | 20.9 | 158 |
| 5 | 35 | 0.5 | 1.4 | 29.8 | 225 |
| 6 | 35 | 0.25 | 0.75 | 6.9 | 31.5 |
| 7 | 35 | 0.13 | 0.37 | 4.7 | 17.4 |
| 8 | 35 | 0.05 | 0.15 | 2.5 | 7.6 |
| 9 | Control | 0 | 0 | 1.6 | 3.9 |
| 10 | 65 | 1.0 | 1.5 | >300 | >300 |
| 11 | 65 | 0.5 | 0.75 | 78.9 | >300 |
| 12 | 35 | 0.5 | 1.4 | 18.4 | 147 |

Various codes of the examples were selected for XPS analysis of silicon. Table 2 summarizes the data. Table 2 shows the differences when the z-direction penetration of the polysiloxane in the tissue sheet is controlled.

TABLE 2

| Example | % Atomic % Si Outside Face | % Atomic Si Inside Face | % Si Gradient |
|---|---|---|---|
| 1 | 14.1 | 13.4 | 5.0 |
| 3 | 8.2 | 7.4 | 9.7 |
| 5 (Invention) | 5.2 | 2.2 | 57.6 |
| 7 (Invention) | 5.1 | 1.7 | 66.7 |
| 12 (Invention) | 12.4 | 7.1 | 42.7 |

We claim:

1. A method for making a layered tissue sheet that is comprised of two outer surfaces and at least two layers, the method comprising:

a) forming at least a first aqueous suspension of pulp fibers comprising polysiloxane pretreated pulp fibers;

b) forming at least a second aqueous suspension of pulp fibers comprising non-treated pulp fibers;

c) forwarding the first aqueous suspension of pulp fibers comprising polysiloxane pretreated pulp fibers to a stratified headbox having at least two layers such that the first aqueous suspension of pulp fibers is directed to at least one of the layers of the headbox;

d) forwarding the second aqueous suspension of pulp fibers comprising non-treated pulp fibers to a different layer of the headbox than the first aqueous suspension of pulp fibers; and, e) depositing the first and the second aqueous suspensions of pulp fibers onto a forming fabric thereby forming a wet layered tissue sheet comprising at least one layer comprising polysiloxane pretreated pulp fibers and at least one layer comprising non-treated pulp fibers, wherein at least layer comprising polysiloxane pretreated pulp fibers is adjacent to a layer comprising non-treated pulp fibers.

2. A method for making a layered tissue sheet of claim 1, further comprising dewatering the wet layered tissue sheet thereby forming a dewatered layered tissue sheet.

3. The method for making a layered tissue sheet of claim 2, further comprising drying the dewatered layered tissue sheet thereby forming a dried layered tissue sheet.

4. The method for making a layered tissue sheet of claim 1, wherein the layered tissue sheet comprises at least three layers wherein two layers are outer layers and at least one layer is an inner layer.

5. The method for making a layered tissue sheet of claim 4, wherein at least one layer of the layered tissue sheet comprises the non-treated pulp fiber.

6. The method for making a layered tissue sheet of claim 5, wherein the layer comprising the non-treated pulp fiber is an inner layer.

7. The method for making a layered tissue sheet of claim 3, wherein at least one outer layer of the layered tissue sheet comprises polysiloxane pretreated pulp fibers.

8. The method for making a layered tissue sheet of claim 4, wherein both outer layers of the layered tissue sheet comprise polysiloxane pretreated pulp fibers.

9. The method for making a layered tissue sheet of claim 1, wherein the layered tissue sheet has a bulk of greater than about 2 $cm^3/g$.

10. The method for making a layered tissue sheet of claim 1, wherein the polysiloxane pretreated pulp fibers have been treated with a polysiloxane having the general structure of:

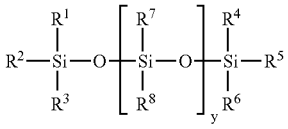

wherein:

each $R^1$–$R^8$ moiety comprises independently an organofunctional group or mixtures thereof; and, y is an integer greater than 1.

11. The method for making a layered tissue sheet of claim 10, wherein each $R^1$–$R^8$ comprises independently a $C_1$ or higher of alkyl groups, aryl groups, ethers, polyethers, polyesters, amines, imines, amides, or mixtures thereof.

12. The method for making a layered tissue sheet of claim 1, wherein the polysiloxane pretreated pulp fibers have been treated with an amino functional polysiloxane having the general structure of:

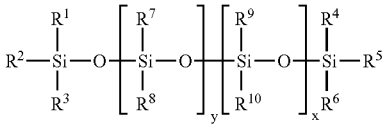

wherein:

x and y are integers >0;

the mole ratio of x to (x+y) is from about 0.005 percent to about 25 percent;

each $R^1$–$R^8$ moiety comprises independently an organofunctional group or mixtures thereof; and, $R^{10}$ comprises an amino functional moiety or mixtures thereof.

13. The method for making a layered tissue sheet of claim 12, wherein each $R^1$–$R^9$ moiety comprises independently a $C_1$ or higher of alkyl groups, aryl groups, ethers, polyethers, polyesters, amides, or mixtures thereof.

14. The method for making a layered tissue sheet of claim 1, wherein the polysiloxane pretreated pulp fibers have been treated with a amino functional polysiloxane having the general structure of:

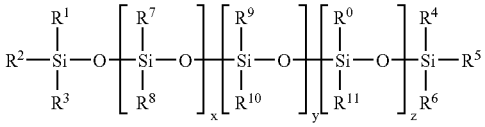

wherein:

x and z are integers >0;

y is an integer greater than 0;

the mole ratio of x to (x+y+z) is from about 0.05 percent to about 95 percent;

the mole ratio of y to (x+y+z) is from about 25 percent or less;

each $R^0$–$R^9$ comprises independently an organofunctional group or mixtures thereof;

$R^{10}$ comprises an amino functional moiety or mixtures thereof; and, $R^{11}$ comprises a hydrophilic functionality or mixtures thereof.

15. The method for making a layered tissue sheet of claim 14, wherein each $R^0$–$R^9$ moiety comprises independently a $C_1$ or higher of alkyl groups, aryl groups, ethers, polyethers, polyesters, amines, imines, amides, substituted amides, or mixtures thereof.

16. The method for making a layered tissue sheet of claim 14, wherein $R^{10}$ comprises an amino functional moiety selected from a primary amine, secondary amine, tertiary amine, quaternary amine, unsubstituted amide, and mixtures thereof.

17. The method for making a layered tissue sheet of claim 14, wherein $R^{11}$ comprises a polyether functional group having the formula: $—R^{12}—(R^{13}—O)_a—(R^{14}O)_b—R^{15}$ wherein:

each $R^{12}$, $R^{13}$, and $R^{14}$ comprises independently branched $C_{1-4}$ alkyl groups, linear $C_{1-4}$ alkyl groups, or mixtures thereof;

$R^{15}$ comprises H, $C_{1-30}$ alkyl group, or mixtures thereof; and, a and b are integers of from about 1 to about 100.

18. The method for making a layered tissue sheet of claim 1, wherein the polysiloxane has a viscosity of about 25 centipose or greater.

19. The method for making a layered tissue sheet of claim 1, wherein at least one layer comprising polysiloxane pretreated pulp fibers constitutes about 80% or less of the total dry pulp fiber weight of the layered tissue sheet.

20. The method for making a layered tissue sheet of claim 1, wherein the layered tissue sheet comprising polysiloxane pretreated pulp fibers has a caliper of about 1200 microns or less.

21. The method for making a layered tissue sheet of claim 1, wherein the layered tissue sheet has a z-directional polysiloxane gradient of about 20% or greater.

22. The method for making a layered tissue sheet of claim 1, wherein the total amount of polysiloxane in the layered tissue sheet is from about 0.01% to about 5% by weight of the total dry pulp fiber weight of the tissue sheet.

23. The method for making a layered tissue sheet of claim 1, wherein at least one layer comprising polysiloxane pretreated pulp fibers further comprises non-treated pulp fibers such that the ratio of polysiloxane pretreated pulp fibers to the non-treated pulp fibers in the layer is from about 5% to about 100% by weight on a dry fiber basis.

24. The method for making a layered tissue sheet of claim 1, wherein the polysiloxane pretreated pulp fibers comprise hardwood kraft pulp fibers.

25. The method for making a layered tissue sheet of claim 1, wherein the non-treated pulp fibers comprise softwood kraft pulp fibers.

26. The method for making a layered tissue sheet of claim 1, wherein the non-treated pulp fibers comprise softwood kraft pulp fibers, hardwood kraft pulp fibers, or mixtures thereof.

27. The method for making a layered tissue sheet of claim 1, further comprising controlling the width of the layer comprising polysiloxane treated pulp fibers relative to the width of the adjacent layer comprising non-treated pulp fibers such that the layered tissue sheet has a wet out time of about 240 seconds or less.

28. The method for making the layered tissue sheet of claim 1, wherein at least one of the outer layers of the layered tissue sheet comprises polysiloxane pretreated pulp fibers, and a z-directional polysiloxane gradient of about 20% or greater wherein the atomic % Si on the outer layer having the highest level of polysiloxane is about 3% or greater.

29. A method for making a multi-ply tissue product comprising polysiloxane pretreated pulp fibers comprising plying together at least two layered tissue sheets wherein two of the layered tissue sheets are outer tissue sheets of the multi-ply tissue product, each layered tissue sheet is comprised of at least two outer layers, and at least one of the layered tissue sheets is made by the method of claim 1.

30. The method for making a multi-ply tissue product of claim 27, wherein the two outer layered tissue sheets are superimposed such that one outer layer of each outer layered tissue sheet forms an outer surface of the multi-ply tissue product and at least one outer surface of the multi-ply tissue product comprises polysiloxane pretreated pulp fibers.

31. The method for making a multi-ply tissue product of claim 27, wherein the two outer layered tissue sheets are superimposed such that one outer layer of each outer layered tissue sheet forms an outer surface of the multi-ply tissue product and both outer surfaces of the multi-ply tissue product comprises polysiloxane pretreated pulp fibers.

32. The method for making the multi-ply tissue product of claim 27, further comprising controlling, in sheets containing the polysiloxane pretreated pulp fibers, the width of the layer comprising polysiloxane pretreated pulp fibers of at least one layered tissue sheet comprising polysiloxane pretreated pulp fibers relative to the width of the adjacent layer comprising non-treated pulp fibers such that the layered tissue sheet has a wet out time of about 240 seconds or less.

33. The method for making the multi-ply tissue product of claim 27, wherein at least one of the outer layered tissue sheets comprises polysiloxane pretreated pulp fibers, and has a z-directional polysiloxane gradient of about 20% or greater wherein the atomic % Si on the outer layer having the highest level of polysiloxane is about 3% or greater.

34. The method for making a layered tissue sheet of claim 27 wherein the wet out time is about 120 seconds or less.

35. The method for making a layered tissue sheet of claim 27 wherein the wet out time is about 90 seconds or less.

36. The method for making a layered tissue sheet of claim 27 wherein the wet out time is from about 7 to about 32 seconds.

37. The method for making a layered tissue sheet of claim 14 wherein each $R^0$–$R^9$ moiety comprises independently a $C_1$ or higher alkyl group.

38. A tissue product, having two outer surfaces and at least one layered tissue sheet having two outer layers, comprising:

a) at least one layer of the layered tissue sheet comprises polysiloxane pretreated pulp fibers and non-treated pulp fibers; and b) at least one layer of the layered tissue sheet comprises non-treated pulp fibers, wherein at least one layer comprising polysiloxene pretreated pulp fibers is adjacent to a layer comprising non-treated pulp fibers, wherein the polysiloxane pretreated pulp fibers have been treated with an amino functional polysiloxane having the general structure of:

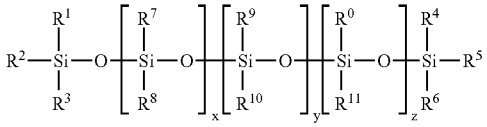

wherein:

x and z are integers >0;

y is an integer >0;

the mole ratio of x to (x+y+z) is from about 0.05 percent to about 95 percent;

the mole ratio of y to (x+y+z) is about 25 percent or less;

each $R^0$–$R^9$ comprises independently an organofunctional group or mixtures thereof;

$R^{10}$ comprises an amino functional moiety or mixtures thereof; and $R^{11}$ comprises a hydrophilic functionality or mixtures thereof.

39. The tissue product of claim 38 wherein at least one layered tissue sheet comprising polysiloxane pretreated pulp fibers comprises at least three layers.

40. The tissue product of claim 38 wherein at least one outer layer of the layered tissue sheet comprises the polysiloxane pretreated pulp fibers.

41. The tissue product of claim 38 wherein both outer layers of the layered tissue sheet comprises the polysiloxane p retreated pulp fibers.

42. The tissue product of claim 38 wherein the tissue product has a bulk of about 2 $cm^3/g$ or greater.

43. The tissue product of claim 38 wherein each $R^0$–$R^9$ moiety comprises independently a $C_1$ or higher of alkyl groups, aryl groups, ethers, polyethers, polyesters, amines, imines, amides, substituted amides, or mixtures thereof.

44. The tissue product of claim 38 wherein $R^{10}$ comprises an amino functional moiety selected from a primary amine, secondary amine, tertiary amine, quaternary amine, unsubstituted amide, and mixtures thereof.

45. The tissue product of claim 38 wherein $R^{11}$ comprises a polyether functional group having the formula: $—R^{12}—(R^{13}—O)_a—(R^{14}O)_b—R^{15}$ wherein:

each $R^{12}$, $R^{13}$, and $R^{14}$ comprises independently branched $C_{1-4}$ alkyl groups, linear $C_{1-4}$ alkyl groups, or mixtures thereof;

$R^{15}$ comprises H, $C_{1-30}$ alkyl group, or mixtures thereof; and a and b are integers of from about 1 to about 100.

46. The tissue product of claim 38 wherein the polysiloxane has a viscosity of about 25 centipoise or greater.

47. The tissue product of claim 38 wherein at least one layer of the layered tissue sheet of the tissue product comprising polysiloxane pretreated pulp fibers constitutes about 50% or less of the total dry pulp fiber weight of the layered tissue sheet.

48. The tissue product of claim 38 wherein at least one layered tissue sheet comprising polysiloxane pretreated pulp fiber has a caliper of about 1200 microns or less.

49. The tissue product of claim 38 wherein at least one layered tissue sheet comprising polysiloxane pretreated pulp fibers has a z-directional polysiloxane gradient of about 20% or greater.

50. The tissue product of claim 38 wherein the total amount of polysiloxane in at least one layered tissue sheet comprising the polysiloxane pretreated pulp fibers is from about 0.01% to about 5% by weight of the total dry pulp fiber weight of the layered tissue sheet.

51. The tissue product of claim 38 wherein the ratio of polysiloxane pretreated pulp fibers in at least one layered tissue sheet comprising polysiloxane pretreated pulp fibers to the non-treated pulp fibers in the layer comprising the polysiloxane pretreated pulp fibers is from about 5% to about 100% by weight on a dry pulp fiber basis.

52. The tissue product of claim 38 wherein at least one layer comprising non-treated pulp fibers in the layered tissue sheet comprising polysiloxane pretreated pulp fibers constitutes about 20% or more of the weight of the layered tissue sheet.

53. The tissue product of claim 38 wherein the polysiloxane pretreated pulp fibers comprise hardwood kraft pulp fibers.

54. The tissue product of claim 38 wherein the non-treated pulp fibers in at least one layered tissue sheet comprising the polysiloxane pretreated pulp fibers comprises softwood kraft pulp fibers, hardwood kraft pulp fibers, or a mixture of hardwood kraft pulp fibers and softwood kraft pulp fibers.

55. The tissue product of claim 38 wherein the tissue product has a wet out time of about 240 seconds or less.

56. The tissue product of claim 38 wherein at least one of the outer layers of the layered tissue sheet comprises polysiloxane pretreated pulp fibers, and a z-directional polysiloxane gradient of about 20% or greater wherein the atomic % Si on the outer layer having the highest level of polysiloxane is about 3% or greater.

57. The tissue product of claim 56 wherein the atomic % Si on the outer layer having the highest level of polysiloxane Is about 5% or greater.

58. The tissue product of claim 38 wherein at least one outer layer of the layered tissue sheet forms one of the outer surfaces of the tissue product.

59. A multi-ply tissue product having two outer surfaces and at least one outer tissue sheet having at least two layers thereby forming a layered tissue sheet comprising:

a) at least one layer of the layered tissue sheet comprises polysiloxane pretreated pulp fibers and non-treated fibers;

b) at least one layer of the layered tissue sheet comprises non-treated pulp fibers, wherein at least one layer comprising polysiloxane pretreated pulp fibers is adjacent the layer comprising non-treated pulp fibers, wherein the polysiloxane pretreated pulp fibers have been treated with a amino functional polysiloxane having the general structure of:

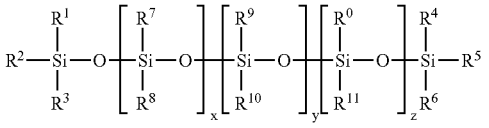

wherein:

x and z are integers >0;

y is an integer >0;

the mole ratio of x to (x+y+z) is from about 0.05 percent to about 95 percent;

the mole ratio of y to (x+y+z) is about 25 percent or less;

each $R^0$–$R^9$ comprises independently an organofunctional group or mixtures thereof;

$R^{10}$ comprises an amino functional moiety or mixtures thereof; and $R^{11}$ comprises a hydrophilic functionality or mixtures thereof.

60. A two-ply tissue product having two outer surfaces and two outer tissue sheets having at least two layers thereby forming a layered tissue sheet comprising:

a) at least one layer of each layered tissue sheet comprises polysiloxane pretreated pulp fibers and non-treated pulp fibers wherein the ratio of polysiloxane pretreated pulp fibers to non-treated pulp fibers by weight is from about 5% to about 95%;

b) at least one layer of each layered tissue sheet comprises non-treated pulp fibers, wherein at least one layer comprising polysiloxane pretreated pulp fibers is adjacent the layer comprising non-treated pulp fibers, wherein the polysiloxane pretreated pulp fibers have been treated with a amino functional polysiloxane having the general structure of:

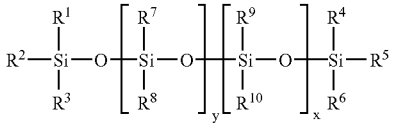

wherein:

x and z are integers >0;

y is an integer >0;

the mole ratio of x to (x+y+z) is from about 0.05 percent to about 95 percent;

the mole ratio of y to (x+y+z) is about 25 percent or less;

each $R^0$–$R^9$ comprises independently an organofunctional group or mixtures thereof;

$R^{10}$ comprises an amino functional moiety or mixtures thereof; and $R^{11}$ comprises a hydrophilic functionality or mixtures thereof.

61. The multi-ply tissue product of claim 59 or 60 wherein at least one layered tissue sheet comprising polysiloxane pretreated pulp fibers comprises at least three layers of pulp fibers.

62. The multi-ply tissue product of claim 59 or 60 wherein at least two layers of the layered tissue sheet comprising polysiloxane pretreated pulp fibers further comprise non-treated pulp fibers.

63. The multi-ply tissue product of claim 59 or 60 wherein at least one layer of the layered tissue sheet comprising non-treated pulp fibers is an inner layer.

64. The multi-ply tissue product of claim 59 or 60 wherein at least one outer layer of the layered tissue sheets comprises the polysiloxane pretreated pulp fibers.

65. The multi-ply tissue product of claim 59 or 60 wherein the multi-ply tissue product has a bulk of about 2 $cm^3/g$ or greater.

66. The multi-ply tissue product of claim 59 or 60 wherein each $R^0$–$R^9$ moiety comprises independently a $C_1$ or higher of alkyl groups, aryl groups, ethers, polyethers, polyesters, amines, imines, amides, substituted amides, or mixtures thereof.

67. The multi-ply tissue product of claim 59 or 60 wherein $R^{10}$ comprises an amino functional moiety selected from a primary amine, secondary amine, tertiary amine, quaternary amine, unsubstituted amide, and mixtures thereof.

68. The multi-ply tissue product of claim 59 or 60 wherein $R^{11}$ comprises a polyether functional group having the formula: $—R^{12}—(R^{13}—O)_a—(R^{14}O)_b—R^{15}$ wherein:

each $R^{12}$, $R^{13}$, and $R^{14}$ comprises independently branched $C_{1-4}$ alkyl groups, linear $C_{1-4}$ alkyl groups, or mixtures thereof;

$R^{15}$ comprises H, $C_{1-30}$ alkyl group, or mixtures thereof; and a and b are integers of from about 1 to about 100.

69. The multi-ply tissue product of claim 59 or 60 wherein the polysiloxane has a viscosity of about 25 centipoise or greater.

70. The multi-ply tissue product of claim 59 or 60 wherein at least one layer of at least one of the layered tissue sheets comprising polysiloxane pretreated pulp fibers constitutes about 50% or less of the total dry pulp fiber weight of the layered tissue sheet.

71. The multi-ply tissue product of claim 59 or 60 wherein at least one layered tissue sheet comprising polysiloxane pretreated pulp fiber has a caliper of about 1200 microns or less.

72. The multi-ply tissue product of claim 59 or 60 wherein at least one of the layered tissue sheets comprising the polysiloxane pretreated pulp fibers has a z-directional polysiloxane gradient of about 20% or greater.

73. The multi-ply tissue product of claim 59 or 60 wherein both outer tissue sheets of the multi-ply tissue product comprise polysiloxane pretreated pulp fibers and wherein both of the outer tissue sheets have a z-directional polysiloxane gradient of about 20% or greater.

74. The multi-ply tissue product of claim 59 or 60 wherein the total amount of polysiloxane in at least one layered tissue sheet comprising the polysiloxane pretreated pulp fibers is from about 0.01% to about 5% by weight of the total dry pulp fiber weight of the layered tissue sheet.

75. The multi-ply tissue product of claim 59 or 60 wherein in at least one layered tissue sheet comprising polysiloxane pretreated pulp fibers, the ratio of polysiloxane pretreated pulp fibers to non-treated pulp fibers in the layered tissue sheet is from about 5% to about 100% by weight on a dry pulp fiber basis.

76. The multi-ply tissue product of claim 59 or 60 wherein at least one layer comprising non-treated pulp fibers in the layered tissue sheets comprising polysiloxane pretreated pulp fibers constitutes about 20% or more of the weight of the layered tissue sheet.

77. The multi-ply tissue product of claim 59 or 60 wherein the non-treated pulp fibers in at least one layered tissue sheet comprising polysiloxane pretreated pulp fibers comprises softwood kraft pulp fibers, hardwood kraft pulp fibers or a mixture of hardwood kraft pulp fibers and softwood kraft pulp fibers.

78. The multi-ply tissue product of claim 77 wherein the non-treated pulp fibers in the layered tissue sheet comprising polysiloxane pretreated pulp fibers further comprise softwood kraft pulp fibers.

79. The multi-ply tissue product of claim 60 wherein the tissue product has a wet out time of about 90 seconds or less.

80. The multi-ply tissue product of claim 59 or 60 wherein at least one of the outer layers of the layered tissue sheet comprises polysiloxane pretreated pulp fibers, and a z-directional polysiloxane gradient of about 20% or greater wherein the atomic % Si on the outer layer having the highest level of polysiloxane is about 3% or greater.

81. The multi-ply tissue product of claim 80 wherein the atomic % Si on the outer layer having the highest level of polysiloxane is about 5% or greater.

82. The multi-ply tissue product of claim 59 or 60 wherein at least one outer surface of the multi-ply tissue product is formed from the outer layer of one of the layered tissue sheets comprising the polysiloxane pretreated pulp fibers.

83. The multi-ply tissue product of claim 59 or 60 wherein at least one outer surface of the multi-ply tissue product is formed from an outer layer of one of the layered tissue sheets comprising polysiloxane pretreated pulp fibers and wherein the outer layer of the layered tissue sheet forming an outer surface of the multi-ply tissue product comprises polysiloxane pretreated pulp fibers.

84. The multi-ply tissue product of claim 59 or 60 wherein both outer surfaces of the multi-ply tissue product are formed from outer layers of layered tissue sheets comprising polysiloxane pretreated pulp fibers and wherein the outer layers of the tissue sheets forming the outer surfaces of the multi-ply tissue product comprise polysiloxane pretreated pulp fibers.

85. The multi-ply tissue product of claim 59 or 60 comprising two sheets superimposed to form a two-ply tissue product, wherein both tissue sheets are layered and comprise polysiloxane pretreated pulp fibers.

86. The multi-ply tissue product of claim 85 wherein both outer surfaces of the two ply tissue product are formed from layers comprising polysiloxane pretreated pulp fibers.

87. The multi-ply tissue product of claim 85 wherein at least one layer of at least one layered tissue sheet comprising non-treated pulp fibers constitute at least about 20% by dry weight of the total weight of pulp fibers in the layered tissue sheet.

88. The multi-ply tissue product of claim 85 wherein the polysiloxane pretreated pulp fibers are comprised of hardwood kraft pulp fibers and the layers comprising non-treated pulp fibers are comprised of softwood kraft pulp fibers.

89. The multi-ply tissue product of claim 85 wherein the layers not comprising the polysiloxane pretreated pulp fibers comprise hardwood pulp fibers, softwood pulp fibers, or mixtures thereof.

90. The multi-ply tissue product of claim 85 wherein each tissue sheets comprise two layers.

91. The multi-ply tissue product of claim 85 wherein each tissue sheets comprise three layers.

92. The multi-ply tissue product of claim 85 wherein the two-ply tissue product has a wet out time less than about 240 seconds.

* * * * *